US010605017B2

(12) United States Patent
Moja

(10) Patent No.: US 10,605,017 B2
(45) Date of Patent: Mar. 31, 2020

(54) UNSEATING TOOL FOR DOWNHOLE STANDING VALVE

(71) Applicant: Unseated Tools LLC, Williston, ND (US)

(72) Inventor: Andrew T. Moja, Williston, ND (US)

(73) Assignee: Unseated Tools LLC, Williston, ND (US)

( * ) Notice: Subject to any disclaimer, the term of this patent is extended or adjusted under 35 U.S.C. 154(b) by 234 days.

(21) Appl. No.: 15/901,429

(22) Filed: Feb. 21, 2018

(65) Prior Publication Data

US 2018/0371857 A1 Dec. 27, 2018

Related U.S. Application Data

(63) Continuation-in-part of application No. 29/883,847, filed on Jul. 25, 2017.
(Continued)

(51) Int. Cl.
*E21B 23/00* (2006.01)
*E21B 34/06* (2006.01)
(Continued)

(52) U.S. Cl.
CPC ..... *E21B 23/00* (2013.01); *E21B 23/006* (2013.01); *E21B 34/06* (2013.01); *E21B 43/126* (2013.01);
(Continued)

(58) Field of Classification Search
CPC ..... E21B 31/20; E21B 31/00; E21B 31/18
See application file for complete search history.

(56) References Cited

U.S. PATENT DOCUMENTS 1,576,597 A 3/1926 Goss
1,614,771 A 1/1927 Axelson et al.
(Continued)

FOREIGN PATENT DOCUMENTS

GB 2314391 A 12/1997

OTHER PUBLICATIONS

Cox, B.R. and B.J. Williams; Methods to Improve the Efficiency of Rod-Drawn Subsurface Pumps; SPE, conference-paper/SPE-18828-MS; Published Mar. 13, 1989, Society of Petroleum Engineers; Oklahoma City, Oklahoma; Retrieved Mar. 19, 2018, from URL: https://www.onepetro.org:443/conference-paper/SPE-18828-MS.
(Continued)

*Primary Examiner* — William D Hutton, Jr.
*Assistant Examiner* — Steven A MacDonald
(74) *Attorney, Agent, or Firm* — Peter Brewer; Thrive IP

(57) ABSTRACT

A standing valve puller is provided. The standing valve puller is configured to latch onto an engagement pin when the engagement pin is run into the standing valve puller within a wellbore, downhole. The standing valve puller generally includes a tubular housing having an upper end and a lower end. The upper end comprises a pair of pivoting arms dimensioned to receive the engagement pin, while the lower end offers a threaded connector that connects to a standing valve. When the engagement pin is lowered through a through-opening preserved within the arms, the arms pivot to latch onto the engagement pin. When the engagement pin is lowered again, the arms pivot away from the engagement pin, providing a "latch and release" cycle. A method of unseating a standing valve from a seating nipple in a wellbore is also provided herein.

26 Claims, 13 Drawing Sheets

Related U.S. Application Data

(60) Provisional application No. 62/523,424, filed on Jun. 22, 2017.

(51) Int. Cl.
*E21B 43/12* (2006.01)
*E21B 34/00* (2006.01)
*E21B 31/18* (2006.01)

(52) U.S. Cl.
CPC ..... *E21B 31/18* (2013.01); *E21B 2034/002* (2013.01)

(56) References Cited

U.S. PATENT DOCUMENTS 1,628,901 A 5/1927 Neilsen
1,676,661 A * 7/1928 Neilsen ..... F04B 53/10 417/452
1,692,005 A * 11/1928 Stephens ..... F04B 47/00 417/452
1,717,497 A * 6/1929 Davis ..... E21B 31/18 294/86.17
1,726,218 A * 8/1929 Fry ..... E21B 31/20 294/86.2
2,142,494 A 1/1939 Cartwright
2,191,380 A 2/1940 Hall
2,242,602 A 5/1941 Watson
2,260,127 A 10/1941 Tebbetts, Jr.
2,286,550 A 6/1942 Kelly et al.
2,319,514 A 5/1943 Penfield
2,605,131 A 7/1952 Marshall et al.
2,647,008 A 7/1953 Stewart et al.
2,667,626 A * 1/1954 Blancher ..... H04L 27/14 340/854.5
3,208,531 A 9/1965 Tamplen
3,358,765 A 12/1967 Le Blanc
3,584,902 A 6/1971 Vyse
3,606,402 A 9/1971 Medney
3,918,679 A 11/1975 Silvana
3,990,727 A 11/1976 Gallagher
4,004,835 A * 1/1977 Taylor ..... E21B 31/18 294/86.29
4,051,899 A 10/1977 Fredd
4,391,547 A 7/1983 Jackson, Jr. et al.
4,436,125 A 3/1984 Blenkush
4,524,998 A 6/1985 Brisco
4,802,694 A 2/1989 Vargo
4,848,454 A 7/1989 Spears
4,944,345 A 7/1990 Mashaw, Jr.
5,020,591 A 6/1991 Shore
5,058,454 A * 10/1991 Head ..... E21B 19/12 248/74.1
5,149,163 A 9/1992 Pruitt
5,160,180 A 11/1992 Mlynarczyk
5,197,773 A 3/1993 Vick, Jr.
5,356,114 A 10/1994 Havard
5,871,296 A 2/1999 Furukawa et al.
5,915,866 A 6/1999 Furukawa
6,196,309 B1 3/2001 Estilette, Sr.
6,340,261 B1 1/2002 Furukawa
6,554,320 B2 4/2003 Cresswell
6,764,103 B1 7/2004 Moretz
7,311,346 B2 12/2007 Bakke
7,775,291 B2 8/2010 Jacob
8,356,394 B1 * 1/2013 Heinle ..... B25B 27/24 29/221.6
2004/0131480 A1 7/2004 Tessier et al.
2012/0118560 A1 * 5/2012 Mikalsen ..... E21B 31/18 166/99
2016/0208564 A1 * 7/2016 Stachowiak ..... E21B 17/1071
2018/0363830 A1 * 12/2018 Baugh ..... E21B 23/00

OTHER PUBLICATIONS

Hendrix, James R. (Oilwell Div. of U.S. Steel Corp.); Subsurface Sucker-Rod Pumps (1987 PEH Chapter 8); SPE, book/peh/spe-1987-08-peh; Published Circa 1987; Society of Petroleum Engineers; Retrieved Mar. 19, 2018, from URL: https://www.onepetro.org:443/book/peh/spe-1987-08-peh.

Pickford, K.H., and B.J. Moris; Hydraulic Rod-Pumping Units in Offshore Artificial-Lift Applications; SPE, journal-paper/SPE-16922-PA; vol. 4, No. 2; Published May 1989; Society of Petroleum Engineers; Retrieved Mar. 19, 2018, from URL: https://www.onepetro.org:443/journal-paper/SPE-16922-PA.

Moises, Gustavo, et al.; Sucker-Rod Pumping Failures Diagnostic System; SPE, conference-paper/SPE-134975-MS; Published Sep. 19, 2010; Society of Petroleum Engineers; Florence, Italy; Retrieved Mar. 19, 2018, from URL: https://www.onepetro.org:443/conference-paper/SPE-134975-MS.

Okoto, Francis, et al.; Recovery of Marginal Reserves through a Cement Packer within Two Production Packers in Dual Completion Strings; SPE, conference-paper/SPE-167530-MS; Published Aug. 5, 2013; Society of Petroleum Engineers; Lagos, Nigeria; Retrieved Mar. 19, 2018, from URL: https://www.onepetro.org:443/conference-paper/SPE-167530-MS.

W. H. Stone (Union Oil Co. of California); Installation of a Deep-Water, Subsea Completion System; SPE, journal-paper/SPE-6917-PA; vol. 30, No. 10; Published Oct. 1978; Society of Petroleum Engineers; Retrieved Mar. 19, 2018, from URL: https://www.onepetro.org:443/journal-paper/SPE-6917-PA.

J.F. McCafferty (Conoco Inc.); Importance of Compression Ratio Calculations in Designing Sucker Rod Pump Installations; SPE, conference-paper/SPE-25418-MS; Published Mar. 21, 1993; Society of Petroleum Engineers; Oklahoma City, Oklahoma; Retrieved Mar. 19, 2018, from URL: https://www.onepetro.org:443/conference-paper/SPE-25418-MS.

Screen Shots of a Farr Plunger Pumps Catalog; Published Jul. 2014; from http://www.muthpump.com; (copyright 2018).

Catalog of Pumps: Muth Pump Farr Plunger Pumps; Published Jul. 2014; Retrieved Mar. 19, 2018, from URL: http://www.muthpump.com/farr-plunger/.

Lester C. Uren; Principles of Deep Well Pumping; SPE-925130-G; vol. G-25, No. 01; Published Dec. 1925; Society of Petroleum Engineers; Retrieved Mar. 19, 2018, from URL: https://www.onepetro.org/journal-paper/SPE-925130-G.

Juch, A.H. and R.J. Watson; New Concepts in Sucker-Rod Pump Design; SPE-2172-PA; vol. 21, No. 03; Published Mar. 1969; Society of Petroleum Engineers; Retrieved Mar. 19, 2018, from URL: https://www.onepetro.org/journal-paper/SPE-2172-PA.

Selected pages from Dura Products Catalog; Retrieved Mar. 19, 2018; now published at URL: https://www.distributionnow.com/content/documents/products/Dura_-_Product_Catalog.pdf.

* cited by examiner

UNSEATING TOOL FOR DOWNHOLE STANDING VALVE

STATEMENT OF RELATED APPLICATIONS

This application claims the benefit of U.S. Ser. No. 62/523,424 entitled "Unseating Tool For Downhole Traveling Valve." That application was filed on Jun. 22, 2017, and is incorporated herein in its entirety by reference.

This application also claims the benefit of U.S. Ser. No. 29/883,847 entitled "Two-Pronged Latch For Downhole Tool." That application was filed on Jul. 25, 2017, and is also incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the present invention relates to a tool used to pull or "unseat" a tubular device from a wellbore. Still further, the invention relates to the installation and removal of a standing valve for a downhole pump.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. Particularly in a vertical wellbore, or the vertical section of a horizontal well, a cementing operation is conducted in order to fill or "squeeze" part or all of the annular area with columns of cement. The combination of cement and casing strengthens the wellbore and facilitates the zonal isolation and subsequent completion of potentially hydrocarbon-producing pay zones behind the casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, which is the production casing, is also typically cemented into place.

As part of the completion process, the production casing is perforated at a desired level. Alternatively, a sand screen may be employed at a lowest depth in the event of an open hole completion. Either option provides fluid communication between the wellbore and a selected "pay zone" in a formation. In addition, a string of production tubing may be installed within the wellbore. The lower end of the tubing string is generally open to provide entry for reservoir fluids into the tubing.

Many hydrocarbon wells are unable to produce at commercially viable levels without assistance in lifting the reservoir fluids to the earth's surface. This is particularly true as the well ages and the in situ formation pressure declines. In the case of deeper wells, the long hydrostatic head acts downwardly against the formation, thereby inhibiting the unassisted flow of fluids as production fluids to the surface.

A common approach for urging production fluids to the surface includes the use of a mechanically actuated, positive displacement pump. Mechanically actuated pumps are sometimes referred to as "sucker rod" pumps. The reason is that reciprocal movement of the pump is induced by cycling a string of so-called sucker rods disposed within the production tubing.

A sucker rod pumping installation consists of a positive displacement pump fixed within the lower portion of the production tubing. This pump is typically placed at or just below the level of the perforations. The pump generally consists of a standing valve portion and a traveling valve portion. Each of the standing valve and the traveling valve is typically a ball-and-seat valve, or a valve having multiple balls and seats.

In operation, the standing valve is fixedly installed at the bottom of the production tubing along an inner diameter thereof. Specifically, the standing valve is wedged into an internal constriction, or "seating nipple," formed internally of the tubing string below the fluid level. This may be done by the operator running the standing valve down to the bottom of the production tubing until the standing valve hits the internal constriction, and then slacking off on the rod string, allowing gravity to drop the standing valve down onto the seating nipple. The operator may repeat this process several times, in effect "hammering" the standing valve into place.

The traveling valve portion of the pump is threadedly connected to the end of the rod string. During pumping, downward motion of the sucker rods and connected traveling valve cause the standing valve to close and the traveling valve to open. Production fluids then flow upwards through the open traveling valve. Then, during the upward motion of the sucker rods and connected traveling valve, the standing valve opens and the traveling valve closes. Production fluids are pulled into the wellbore and through the standing valve. At the same time, production fluids previously captured by the traveling valve are lifted up the production string and to the surface.

In the industry today, the standing valve portion of the pump is typically installed by attaching a running tool into the production tubing at the lower end of the traveling valve. This means that the standing valve portion is run into the wellbore with the traveling valve portion at the end of the rod string. Upon reaching a point of frictional engagement (or "seating") between the standing valve and the surrounding production tubing, the rod string is rotated in order to un-thread the traveling valve from the standing valve. The weight of the traveling valve and rod string are then released from the surface, down onto the standing valve. A hammerand-anvil type action "taps" the pump barrel of the standing valve into place and onto the seating nipple. The standing valve is then fixed within the production tubing.

It occasionally becomes necessary to check the traveling valve and the standing valve. Removing the traveling valve from the wellbore is simply a matter of pulling the rod string, removing the traveling valve (or "piston") by unthreading the valve from the lowest joint, and then providing service, maintenance or replacement. However, removing the standing valve is more challenging since the tool is fixedly wedged in the seating nipple of the production tubing downhole. For this, a dedicated standing-valve puller has been used. An example is the Weatherford® API Tap-Type, Standing-Valve Puller available from Weatherford International Ltd. of Houston, Tex.

To remove the standing valve, the standing valve puller is threadedly connected to the lowermost joint of a rod string. The puller and connected rod string are then run into the wellbore, joint-by-joint, to the depth of the standing valve. A lower tip of the standing valve puller is landed into a box connector, which is a threaded opening at the top of the standing valve. The lower tip is then rotated into the box connector. Once engaged, tension is applied to the rod string, causing the standing valve to be unseated. The standing valve is then pulled to the surface for inspection.

Those of ordinary skill in the art will readily understand that the process of removing the standing valve can be difficult and time consuming. In many cases, the standing valve cannot be removed because the threaded opening forming the box connector is clogged with debris, or the threads have become damaged, or the connection is just rusted out. In this instance, the operator must pull the production tubing from the well to change the standing valve assembly. This results in a substantial loss of time and money.

Therefore, a need exists for a procedure by which a running tool and connected standing valve can be quickly removed from the seating nipple of the production tubing without rotation of the rod string and without threading down into the standing valve. Further, a need exists for an unseating tool that can be threadedly connected to the standing valve at the surface, and which stays in the production tubing during well operation. Finally, a need exists for a method of quickly disconnecting from and reconnecting to a standing valve using a standing valve puller, thereby allowing the standing valve to be quickly set in and unseated from the production tubing using the traveling valve itself.

SUMMARY OF THE INVENTION

A standing valve puller is first provided herein. The standing valve puller is designed to threadedly connect to a standing valve using the existing threaded opening at the top of the standard standing valve. The connection is made by hand at the surface before the standing valve is run into a wellbore.

In the present context, the wellbore comprises a string of production tubing. The production tubing has a known seating nipple that is configured to receive a known standing valve.

The standing valve puller is configured to allow retrieval of the known standing valve from the wellbore using the traveling valve itself. In this way, a service company can pull the standing valve at any time while the sucker rods and traveling valve are still in the wellbore. In one embodiment, a pumper at the wellsite can lower the rod string from the surface, connect to the standing valve puller, unseat the standing valve from the seating nipple, and circulate a hot oil treatment or a chemical treatment at the bottom of the wellbore, all without pulling the rod string out of the hole.

The standing valve puller first comprises a tubular housing. The tubular housing has a proximal end and a distal end, and a bore there along. In one aspect, the tubular housing is divided into a top housing component and a bottom housing component. The top and bottom housing components are threadedly connected to form a singular housing.

The standing valve puller additionally includes a threaded connector. The threaded connector has a proximal end and a distal end. The proximal end is configured to threadedly connect to the distal end of the tubular housing, while the distal end comprises male threads that are configured to threadedly connect to a threaded opening (or box connector) at an upper (or proximal) end of the standing valve. The connection between the standing valve puller and the standing valve remains in place during production operations.

The standing valve puller also includes a spring. The spring resides within the bore of the tubular housing and abuts the threaded connector.

The standing valve puller further comprises a sliding component. The sliding component is configured to move along the bore of the tubular housing in response to a downward force applied by an engagement pin. The sliding component includes a series of splines residing radially around an outer diameter of the sliding component.

The standing valve puller additionally has a holding arm component, or "latch.". The latch is made up of at least two opposing arms. Each of the at least two arms is configured to pivot at the proximal end of the tubular housing such that when the engagement pin moves the sliding component downward into the bore a first time, the arms pivot inwardly and latch onto an elongated stem of the engagement pin.

The engagement pin preferably resides at the lower end of a traveling valve. When the engagement pin moves the sliding component downward into the bore a second time, the arms pivot outwardly and release the stem of the engagement pin. In this way, the traveling valve and connected engagement pin and can be raised a selected distance up the production tubing, leaving the standing valve in place.

The arms of the holding arm component, or "latch," reside at the proximal end of the tubular housing. Each arm includes a flange at an upper (or proximal) end. When the arms pivot inwardly, a somewhat cylindrical shape is formed. A through-opening is preserved in the holding arm component through the flanges. The through-opening is dimensioned to closely but slidingly receive the elongated stem of the engagement pin. Of course, when the arms pivot outwardly, the flanges of the arms open up and the engagement pin is released from the through-opening.

In one arrangement, the standing valve puller also includes a twisting component. The twisting component resides within the bore of the tubular housing and forms a generally tubular body. The twisting component comprises a shoulder configured to land on the spring. This enables the spring to apply an upward biasing force to the twisting component. In one aspect, the shoulder of the twisting component resides along an inner diameter of the tubular body forming the twisting component.

The twisting component further includes a series of slots residing radially about the tubular body. The slots alternate between short slots and long slots. A downward action by the sliding component on the twisting component causes the splines to move downwardly along the slots and to radially and sequentially advance the splines from the long slots to the short slots, and then to the long slots again, whenever the engagement pin "clicks" down against the sliding component.

In operation, when the splines move into the long slots, the arms of the holding arm component are pivot inwardly and are held, or fixed, in a latched position. When the splines move into the short slots, the arms of the holding arm component and freed, and can pivot outwardly to a released position.

A fluid pumping system for producing hydrocarbon fluids from a wellbore is also provided herein. Once again, the wellbore has a string of production tubing placed therein.

The fluid pumping system first includes a traveling valve. The traveling valve resides at a lower end of a rod string within the string of production tubing. The fluid pumping system also includes an engagement pin. The engagement pin is connected to the lower end of the traveling valve. Thus, the traveling valve and connected engagement pin move up and down within the production tubing together in response to reciprocal pumping motion of the rod string.

The fluid pumping system next includes a standing valve. The standing valve is landed on a seating nipple or is otherwise releasably fixed within the production tubing.

Additionally, the fluid pumping system comprises a standing valve puller. The standing valve puller is threadedly connected to an upper (or proximal) end of the standing valve. The standing valve puller is designed in accordance with the standing valve puller described above, in its various embodiments. The standing valve puller defines a latching mechanism that allows the engagement pin to sequentially catch and release the standing valve puller in response to a downward (or longitudinal) force applied to the sliding component.

Finally, a method of unseating a standing valve from a seating nipple within a wellbore is offered. In the method, the wellbore has:

- an elongated string of production tubing comprising a series of joints,
- a standing valve secured onto a seating nipple proximate a lower end of the production tubing;
- a standing valve puller threadedly connected onto an upper end of the standing valve;
- a traveling valve secured to a lowermost joint of a sucker rod string; and
- an engagement pin secured to a lower end of the traveling valve.

The method first includes the step of lowering the rod string and connected traveling valve and engagement pin within the production tubing. The method then includes further lowering the rod string and connected traveling valve until the engagement pin enters the standing valve puller. A downward force is then applied to a sliding component within the standing valve puller. This causes arms of a holding arm component, or "latch," to pivot inwardly, and to latch onto the engagement pin above a shoulder.

The method also includes:

- applying an upward tensile force to the rod string and connected traveling valve and engagement pin, with the standing valve puller latched on to the engagement pin;
- removing the sucker rod string from the wellbore, joint-by-joint, along with the connected standing valve puller and standing valve, up to a surface;
- removing the standing valve from the engagement pin at the surface; and
- removing the standing valve from the production tubing.

Preferably, the wellbore is completed in a substantially vertical orientation. Maintenance services may then be performed on the standing valve, or the standing valve may be replaced.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
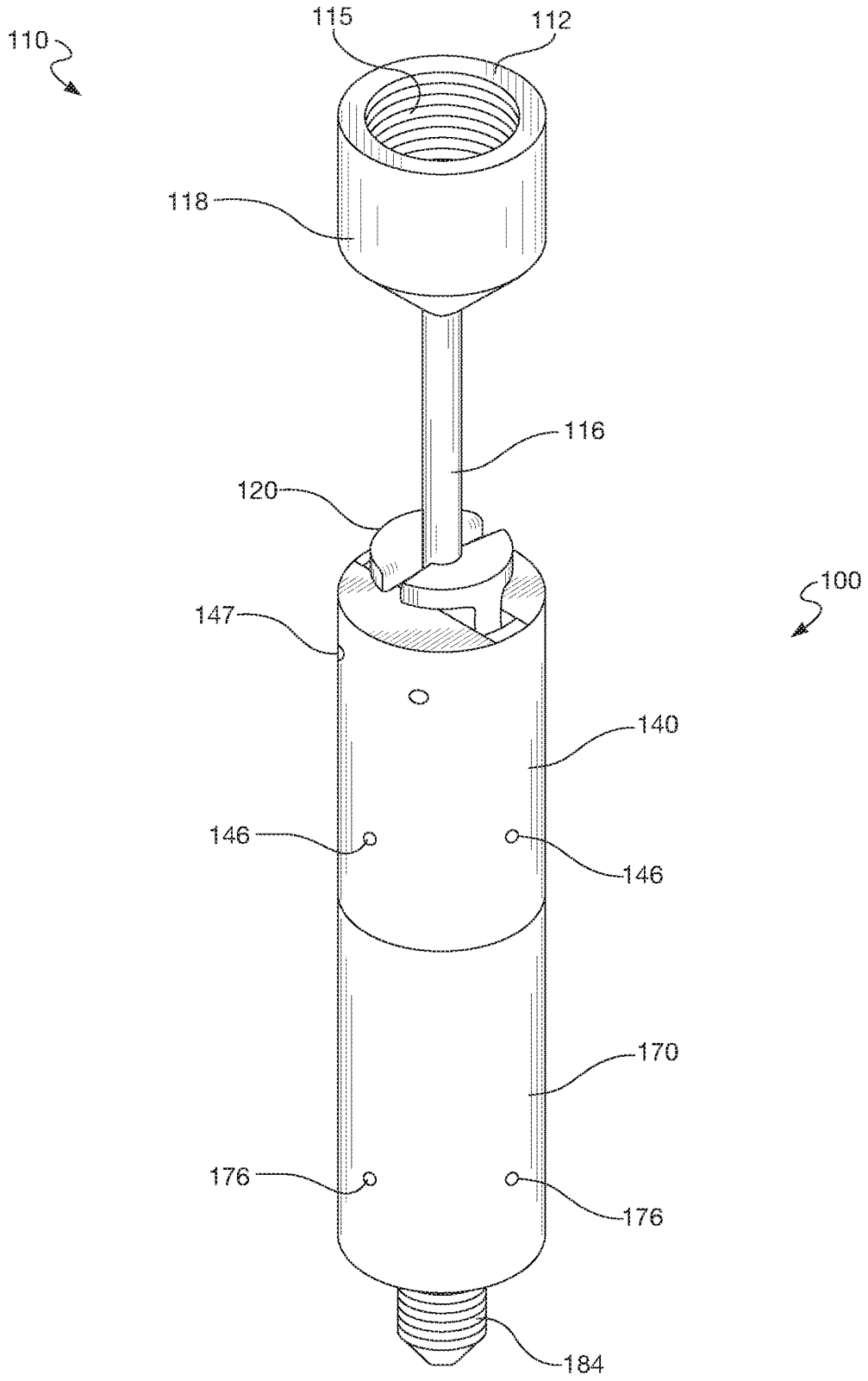
FIG. 1 is a perspective view of a standing valve puller of the present invention, in one embodiment. The standing valve puller has received an engagement pin, seen extending downward into the standing valve puller.

For purposes of the present application, it will be understood that the term "hydrocarbon" refers to an organic compound that includes primarily, if not exclusively, the elements hydrogen and carbon. Examples of hydrocarbon-containing materials include any form of oil, natural gas, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state. The term hydrocarbon fluids may include other elements, such as, but not limited to, halogens, metallic elements, nitrogen, oxygen, and/or sulfur.

As used herein, the term "fluid" refers to gases, liquids, and combinations of gases and liquids, as well as to combinations of gases and fine solids, and combinations of liquids and fine solids.

As used herein, the terms "produced fluids," "reservoir fluids" and "production fluids" refer to liquids and/or gases removed from a subsurface formation, including, for example, a hydrocarbon reservoir, a shale formation or an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "wellbore fluids" means water, hydrocarbon fluids, formation fluids, or any other fluids that may be within a string of production tubing during a production operation.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular" or "tubular member" refer to any pipe, such as a joint of casing, a portion of a liner, a joint of tubing, a pup joint, or coiled tubing. The terms "production tubing" or "tubing joints" refer to any string of pipe through which reservoir fluids are produced.

DESCRIPTION OF SPECIFIC EMBODIMENTS

FIG. 1 is a perspective view of a standing valve puller 100 of the present invention, in one embodiment. The standing valve puller 100 is designed to reside within a wellbore (seen at 900 in FIGS. 9A through 9F) during a production operation. More specifically, the standing valve puller 100 is configured to threadedly connect to a standing valve (shown at 960 in FIGS. 9A through 9F) at the bottom of a string of production tubing (shown at 920 in FIGS. 9A through 9F). The standing valve puller 100 will remain connected to the standing valve 960 within the wellbore 900 during production. When it is desirable to remove the standing valve 960, such as for maintenance, repair or replacement, the operator will latch onto the standing valve puller 100, and then pull the standing valve puller 100 and connected standing valve 960 from the wellbore 900 together (shown in FIGS. 9D through 9F).

The step of latching onto the standing valve puller 100 is done through use of an engagement pin 110. The engagement pin 110 defines an elongated body comprising a proximal (or upper) end 112 and a distal (or lower end) 114. The distal end 114 is seen more fully in FIGS. 2 and 8. Between the proximal end 112 and the distal end 114 is a stem 116. Preferably, the stem 116 is about three inches in length.

In the view of FIG. 1, an engagement pin 110 is seen extending down into the standing valve puller 100. More specifically, the stem 116 has passed through a top of the standing valve puller 100. As will be described more fully below, applying a downward force onto the engagement pin 110 causes the elongated stem 116 to move down into the standing valve puller 100. The standing valve puller 100 is designed in such a way that the downward force will cause arms 125 of a holding arm component 120 at the top of the puller 100 to pivot inwardly and to latch onto the stem 116. Beneficially, applying the same downward force to the engagement pin 110 a second time will cause the arms 125 to pivot away from the stem 116 and to release the engagement pin 110 from the standing valve puller 100. In this way, a "latch and release" cycle is provided that may be performed quickly and repetitively.

As shown in FIG. 1, the proximal end 112 of the engagement pin 110 comprises a somewhat tubular body 118. The body 118 serves as a box connector, meaning it offers female threads 115 within an opening. The body 118 threadedly connects to the lower end of a running string, such as coiled tubing or a sucker rod string. More preferably, the body 118 threadedly connects to the lower end of a traveling valve (seen in FIGS. 9A through 9F at 940). In this way, the operator can use the existing rod string 945 and connected traveling valve 940 to engage the standing valve 960. Thereafter, an upward force is applied to the rod string 945 in order to unseat the standing valve 960. This may be done without removing the rod string 945 from the wellbore 900 beforehand, as required using current technology.

Beneficially, an operator may conduct a hot oil treatment or a chemical treatment downhole without pulling the rod string 945 and connected traveling valve 940 completely out of the hole (known as a "trip," or "TOOH." In one aspect, the standing valve 960 may be raised 5 to 10 feet before a hot oil treatment is conducted. Using the standing valve puller 100 and engagement pin 110, the operator can simply tap down into the standing valve puller 100, causing the arms 125 of the holding arm component 120 to move into their latched position, and them pull up to unseat the standing valve 960. (A nipple seat is shown schematically at 918 of FIGS. 9E and 9F.)

Of course, the operator may sometimes choose to remove the standing valve 960 completely from the wellbore 900. This may be done latching into the standing valve puller 100 and then bringing the sucker rods 940 up to the surface, joint-by-joint, with the traveling valve 940, the standing valve puller 100 and the standing valve 960 all connected together by means of threaded connections and the engagement pin 110. Thus, the present invention allows the traveling valve 940 and standing valve 960 to be pulled together in the same trip.

As noted, the standing valve puller 100 also includes a holding arm component 120. The holding arm component 120 comprises a pair of opposing arms (seen at 125 in FIGS. 2 and 8). Each arm 125 has a through-opening 127 which receives a respective pivot pin (not shown). The arms 125 pivot about the respective pivot pins in such a way that the arms 125 are able to close and open. In so doing, the arms 125 can sequentially "latch and release" the stem 116 of the engagement pin 110 above the distal end 114.

In order to run the standing valve puller 100 and connected standing valve 960 into the wellbore 900, the arms 125 of the holding arm component 120 are manually opened at the surface 901. The engagement pin 110 is then manually pushed into the central bore 105 of the standing valve puller 100 to place the arms 125 in their latched position (FIGS. 1 and 7B).

As shown in FIG. 1, the standing valve puller 100 next includes a tubular housing. The tubular housing is preferably made up of two separate tubular components. These represent a top housing 140 and a bottom housing 170. The tubular housing (components 140/170 together) contains moving parts that represent additional components of the standing valve puller 100. These are discussed below.

Finally, FIG. 1 shows that the standing valve puller 100 includes a lower threaded connector. The full threaded connector is seen at 180 in FIG. 2. However, only a male distal end 184 is visible in FIG. 1. A keyway (not shown) may be provided which will lock the threaded connector 180 to the bottom housing 170.

The threaded distal end 184 of the threaded connector 180 is dimensioned to screw into a threaded opening at the upper end of the standing valve 960. This threaded connection is made by the operator at the surface before the standing valve 960 is run into the production tubing 920 and seated in the seating nipple 918. The threaded end connector 180 will remain stationary after it is connected to the standing valve 960.

Figure 2:
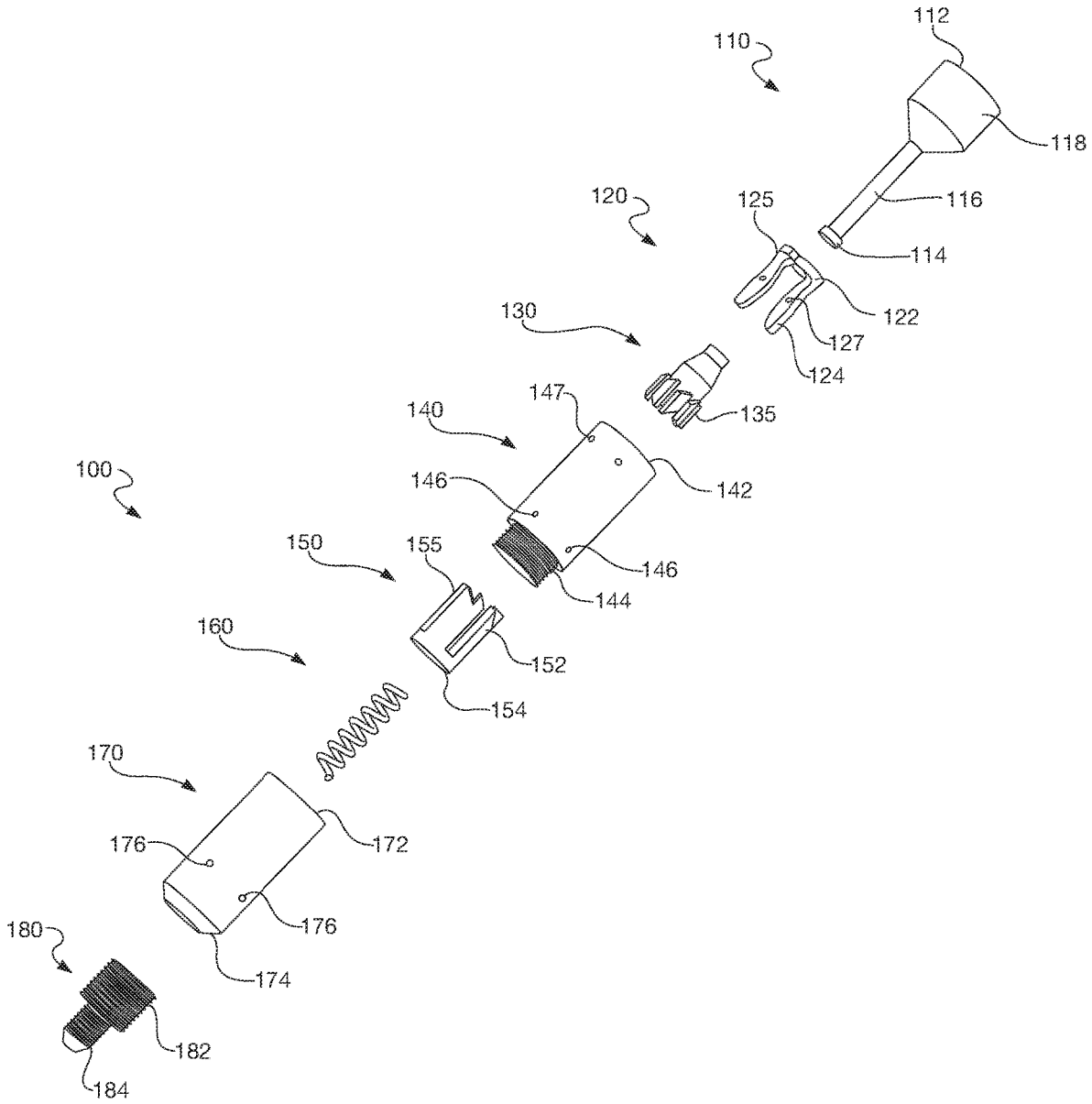
FIG. 2 is an exploded view of the standing valve puller of FIG. 1 along with the engagement pin. Internal components of the standing valve puller are now visible in exploded-apart relation.

Moving now to FIG. 2, FIG. 2 offers an exploded view of the standing valve puller 100 of FIG. 1. Internal components of the standing valve puller 100 are now visible. These include the holding arm component 120, a sliding component 130, the top housing 140, a twisting component 150, a spring 160, the bottom housing 170 and the threaded connector 180.

Along with the standing valve puller 100 and its components, FIG. 2 shows the engagement pin 110 in its entire length. In FIG. 2, the distal end 114 is now seen. The distal end 114 defines a shoulder. When the engagement pin 110 is pulled by the operator from the surface, the shoulder 114 will catch on the arms 125 of the holding arm component 120. More specifically, the shoulder 114 will hit flanges at a proximal end 122 of the holding arms 120 when in their latched position. This is more readily seen in the side view of FIG. 3A, discussed below.

Referring to the holding arm component 120, it is observed that the holding arm component 120 comprises two or more separate arms 125. Each arm 125 has a proximal end 122 and a distal end 124. As noted, the distal end 122 represents a flange used to catch the shoulder 114 of the engagement pin 110 when the holding arm component 120 is in its latched position.

In addition, each arm 125 has a pivot hole 127. As noted above, each pivot hole 127 is dimensioned to receive a respective horizontal pin (not shown). The respective pins reside proximate a top 142 of the top housing 140. The horizontal pins allow the arms 125 to pivot inwardly and outwardly relative to the top housing 140.

The standing valve puller 100 next includes the sliding component 130. The sliding component 130 comprises a generally tubular body wherein splines 135 are placed radially around an outer diameter. As the name implies, the sliding component 130 is configured to move (or slide) longitudinally along the standing valve puller 100. Specifically, the splines 135 slide along channels 146 disposed along an inner diameter of the top housing 140. Two of the channels 146 are seen in FIG. 6B.

Next shown in FIG. 2 is the top housing 140. The top housing 140 is a tubular body comprising a proximal end 142 and a distal end 144. The proximal end 142 includes pivot holes 147 that receive the horizontal pivot pins. In the preferred embodiment, two horizontal pins are used, requiring two pairs of pivot holes 147 located on each side of the top housing 140. In this way, the two opposing arms 125 are pivotally supported.

The proximal end 142 of the top housing 140 defines a pair of slanted surfaces. The slanted surfaces 142 are dimensioned to receive the respective arms 125 when they are pivoted outwardly. Preferably, the arms 125 are biased to pivot outwardly through the use of respective springs (not shown).

The distal end 144 of the top housing 140 comprises a male threaded member. The male threads at the distal end 144 connect to a proximal end 172 of the bottom housing 170, described further below.

FIG. 2 next shows a twisting component 150. The twisting component 150 also represents a somewhat tubular body.

The twisting component 150 comprises a proximal end 152 and a distal end 154. Along the tubular body of the twisting component 150 are longitudinal slots. The slots alternate between long slots and short slots (identified as slots 151 and 157, respectively, in FIG. 4B). Regardless of their length, the slots 151, 157 are dimensioned to slidably receive the splines 135 of the sliding component 130.

Next shown in FIG. 2 is the spring 160. The spring 160 resides within the bottom housing 170. The spring 160 is maintained in compression between a shoulder 182 (visible in FIG. 3B) of the threaded connector 180 and a corresponding shoulder 153 (also visible in FIG. 3B) of the twisting component 150. The spring 160 urges the twisting component 150 upward against the sliding component 130. Stated another way, the spring 160 is used to bias the twisting component 150 into engagement with the twisting component 130. The spring 160 is preferably fabricated from steel.

FIG. 2 next presents the bottom housing 170. As described above, the bottom housing 170 is a tubular body having a proximal end 172 and a distal end 174. The proximal end 172 comprises female threads configured to connect to the male threaded end 144 of the top housing 140. Similarly, the distal end 174 comprises female threads configured to connect to male threads at the proximal end 182 of the threaded connector 180.

It is noted that one or more holes 176 may be drilled into the bottom housing 170. This allows the standing valve puller 100 to be flushed out, either after the puller 100 has been retrieved to the surface, or in response to a hot oil treatment or chemical treatment wherein fluid is injected downhole.

Finally, FIG. 2 shows the threaded connector 180. The threaded connector 180 provides a means for connecting the standing valve puller 100 with the standing valve 960. The threaded connector 180 includes a distal end 184, discussed above in connection with FIG. 1.

In the view of FIG. 2, the threaded connector 180 is shown as a separate component from the bottom housing 170. However, it is understood that the threaded connector 180 may be integral to the bottom housing 170, meaning that the distal end of the housing 170 is actually the threaded male tip 184.

In a preferred embodiment, the standing valve puller 100 is no more than 15 to 24 inches in length, measured from the top 122 of the holding arm component 120 to the bottom 184 of the threaded end connector 180. In addition, the standing valve puller 100 will have an outer diameter no greater than the outer diameter of the standing valve 960 itself. For example, the standing valve puller 100 may have an outer diameter (measured across the housing 140/170) of about 2.0 inches. Therefore, the standing valve puller 100 will not create a restriction to either run-in or to normal wellbore operations.

Figure 3A:
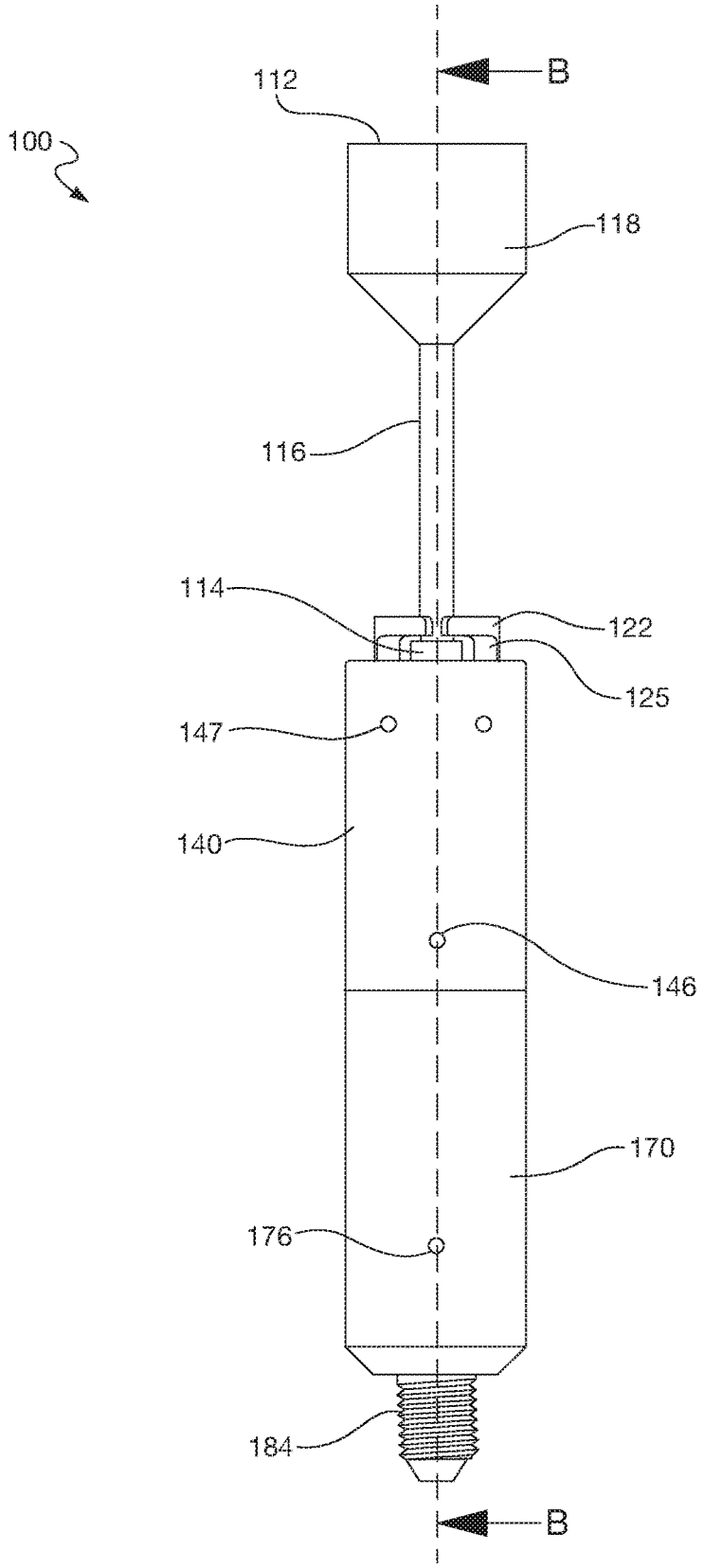
FIG. 3A is a side view of the standing valve puller and the engagement pin of FIG. 1. The standing valve puller is in its "latched" position, meaning that arms of a holding arm component have pivoted inwardly to engage a stem of the engagement pin.

FIG. 3A is a side view of the standing valve puller 100 of FIG. 1. The tubular housing is shown, with the top housing 140 and bottom housing 170 being connected. In addition, the flanges 122 of the arms 125 are shown extending up from the top housing 140.

Also visible in FIG. 3A is the engagement pin 110. It can be seen that the shoulder 114 of the engagement pin has engaged the flanges 122 from underneath. This indicates that the engagement pin 110 is being pulled upward.

Figure 3B:
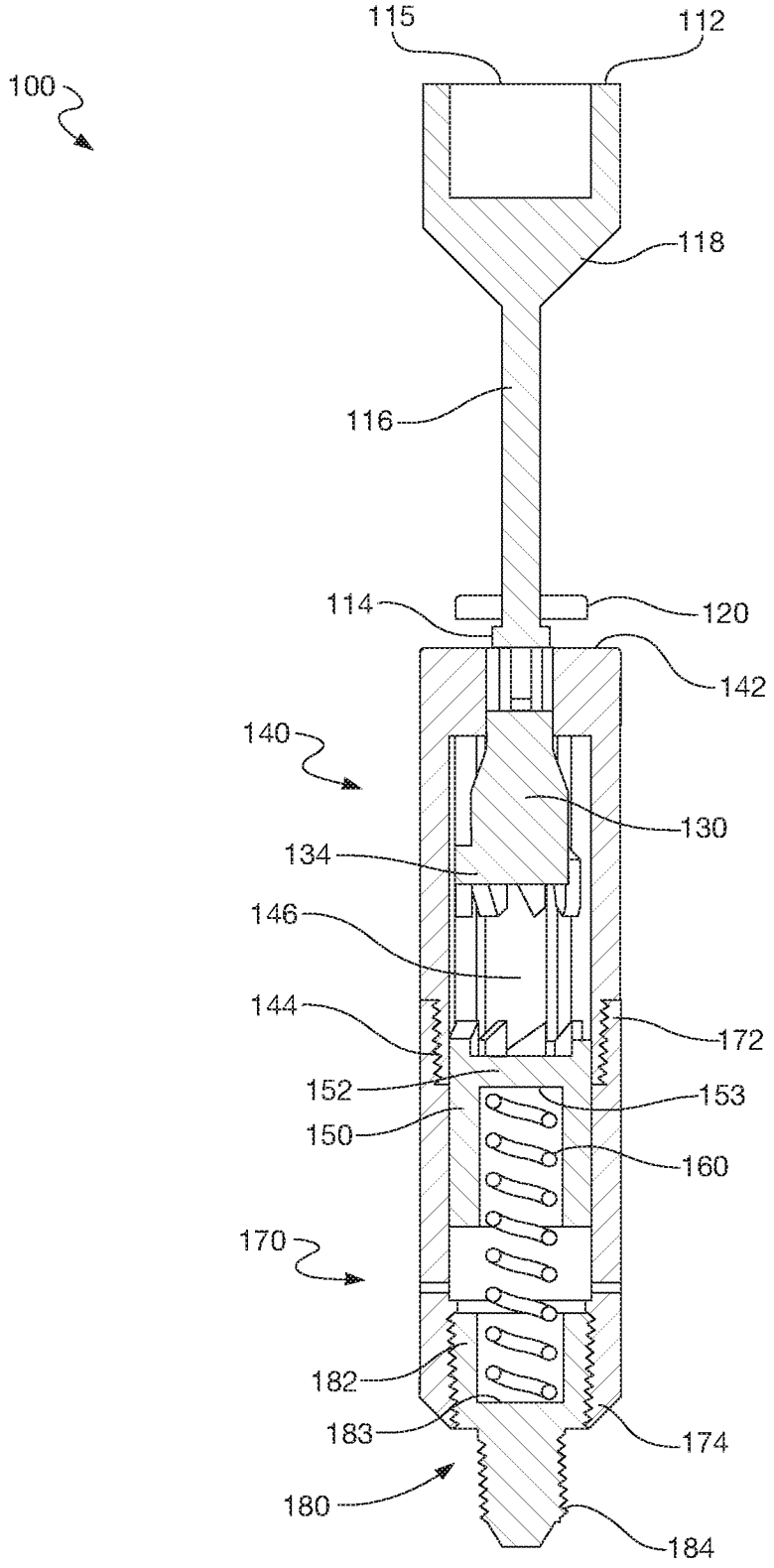
FIG. 3B is a cross-sectional view of the standing valve puller and the engagement pin, taken across Line B-B of FIG. 3A. The standing valve puller is again in its latched position, enabling the engagement pin to pull the standing valve puller and connected standing valve (not shown) from a wellbore.

FIG. 3B is a cross-sectional view of the standing valve puller 100 and the engagement pin 110 of FIG. 3A. The view is taken across Line B-B of FIG. 3A. In this view, the standing valve puller 100 is in a latched position, enabling the shoulder 114 of the engagement pin 110 to "catch" the flanges 122 of the respective arms 125 and pull the standing valve puller 100 and connected standing valve 960 up from a wellbore 900.

Of interest, FIG. 3B shows the spring 160 residing between the shoulder 183 of the threaded connector 180 and the shoulder 153 of the twisting component 150. Here, the spring 160 is not being compressed. The interrelationship between a distal end 134 of the sliding component 130 and a proximal end 152 of the twisting component 150 can also be inferred. When the sliding component 130 is pushed down through the channels 146 in the top housing 140, the toothed profile of the distal end 134 of the sliding component 130 will engage the mating toothed profile of the proximal end 152 of the twisting component 150. This will induce a rotation of the twisting component 150, which radially advances the slots 155 of the twisting component 150 from long 157 to short 151 to long 157, etc. In one aspect, a lower end of the splines 135 is angled, such as at 45-degrees, to urge rotation of the twisting component 150 when the twisting component 150 is acted upon by the sliding component 130.

As the sliding component 130 is forced downward by the engagement pin 110, it will rotate the twisting component 150 into a next position. In the latched position, the sliding component 130 will be forced upwards from the twisting component 150 into the holding arm component 120, under the force of the spring 160 as shown in FIG. 3B. This prevents the arms 125 from pivoting outwardly into the slanted surfaces 142. In the disengaged, or released, position the sliding component 130 will be in a "floating" position. This position will allow the arms 125 of the holding arm component 120 to freely pivot. This further allows the arms 125 to pivot outwardly into the slanted surfaces 142.

It is observed that the downward force of the shoulder 114 of the engagement pin 110 against the sliding component 130 will cause the distal end 134 of the sliding component 130 to engage the proximal end 152 of the twisting component 150. Where the splines 135 of the sliding component engage the long slots 157, the spring 160 will force the twisting component 150 upwards along the top housing 140. At the same time, the sliding component is prevented from twisting because the splines 135 reside in the channels 146 along the inner diameter of the top housing 140.

Figure 4A:
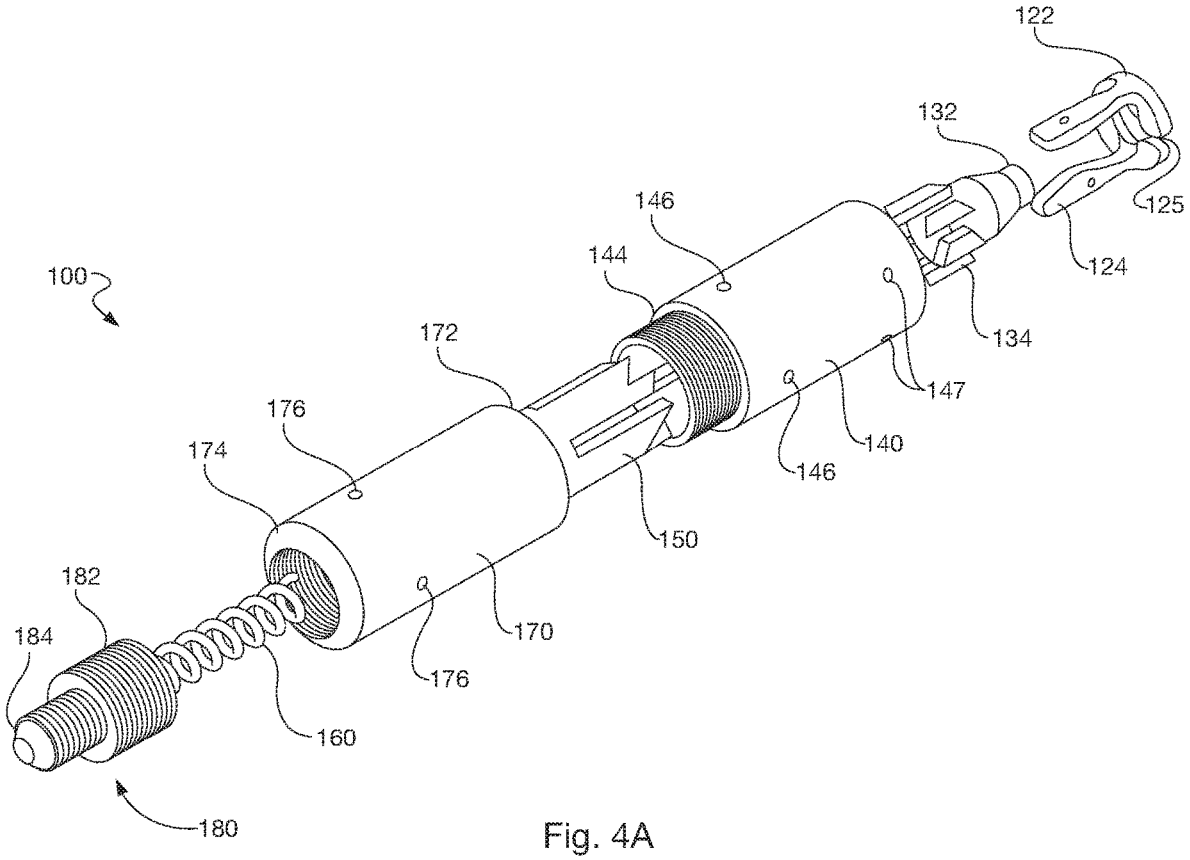
FIG. 4A is another perspective view of the standing valve puller of FIG. 1. Components of the standing valve puller are exploded apart. Here, the engagement pin is not shown.

FIG. 4A is another perspective view of the standing valve puller 100 of FIG. 1. Components of the standing valve puller 100 are partially exploded apart for illustrative purposes. Here, the engagement pin 110 is not shown. Also visible are two of the pivot holes 147 in the top housing 140.

One or more holes 146 may be drilled into the top housing 140. These are drain holes. The drain holes 146 may allow fluids to drain from the puller 100 when the standing valve 960 is being pulled from a wellbore (See, for example, FIG. 9D.)

Figure 4B:
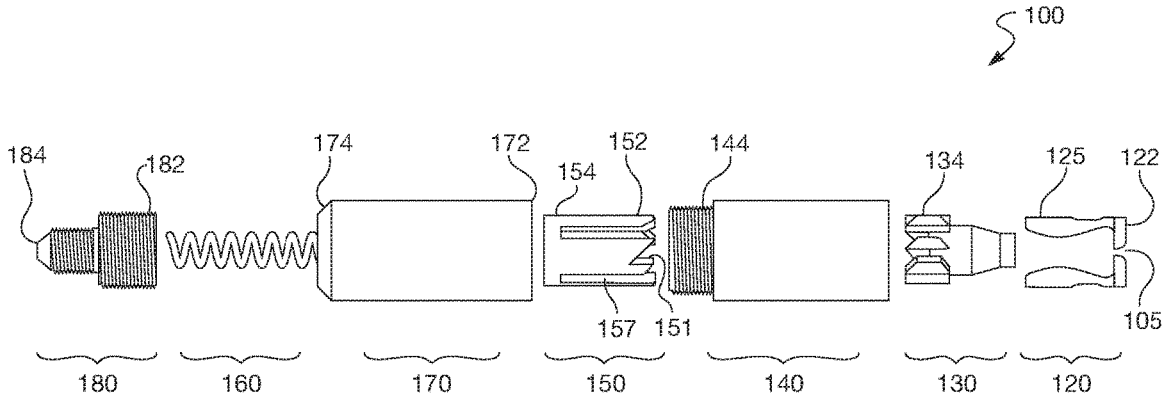
FIG. 4B is a side view of the exploded-apart components of the standing valve puller of FIG. 4A. Of interest, it can be seen that the arms of the holding arm component are independent (not connected) pieces.

FIG. 4B is a side view of the more-fully exploded-apart components of the standing valve puller 100 of FIG. 4A. Of interest, it can be seen that the arms 125 of the holding arm component 120 are independent (not connected) pieces that are able to pivot separately.

Figure 5A:
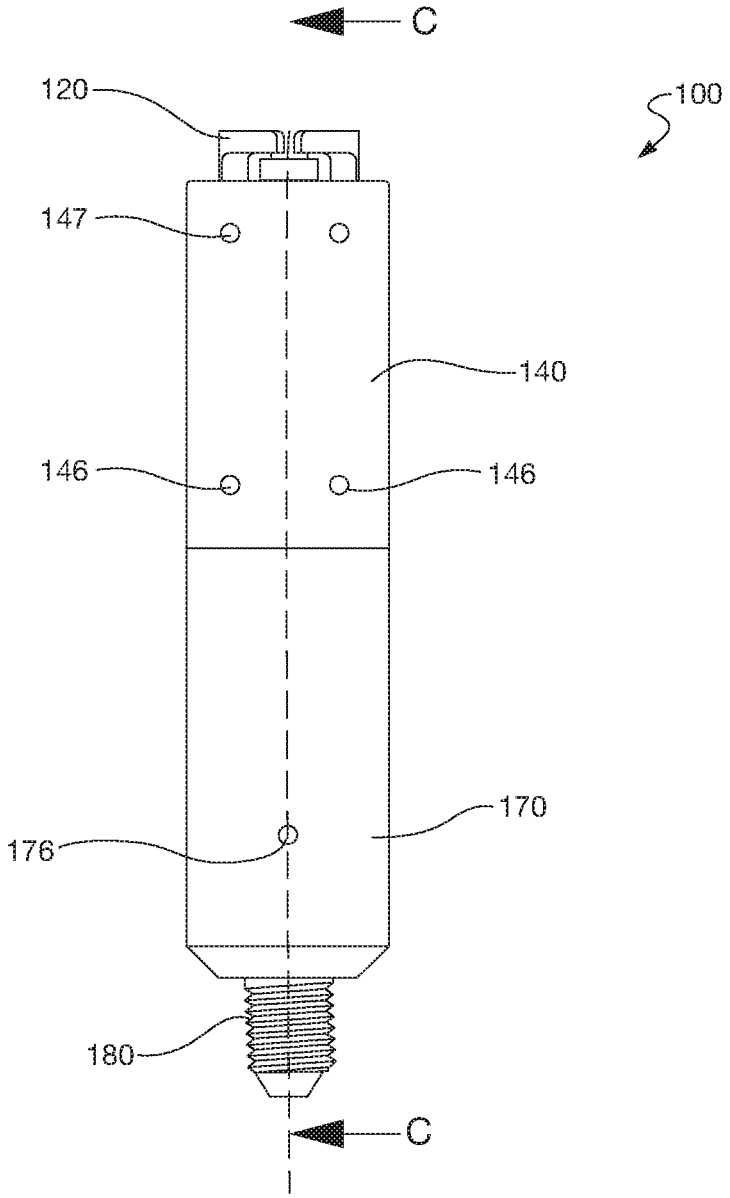
FIG. 5A is a side view of the standing valve puller of FIG. 1, but without the engagement pin.

FIG. 5A is a side view of the standing valve puller 100 of FIG. 1. For illustrative purposes, the engagement pin 110 has been removed. The flanges 122 at the top of the pivot arms 125 are shown in their engaged, or latched, position.

It is understood that this is not the normal operating condition of the standing valve puller 100 during production operations. During production operations, the standing valve 960 remains at the bottom of the production tubing 920, seated on the seating nipple 918. Springs (not shown) are connected to the pivoting arms 125 to bias the arms 125 in an outwardly pivoted relationship. This means that the flanges 122 pivot outwardly and land along a slanted surface (see at 142 of FIG. 6B). The outward pivot keeps the shoulder 114 of the engagement pin 110 from hanging up on the flanges 122 when the engagement pin 110 is being lowered into or is pulled out of the top 142 of the tubular housing 140. However, for illustrative purposes the arms 125 are shown in FIG. 5A in their latched position without the engagement pin 110.

Figure 5B:
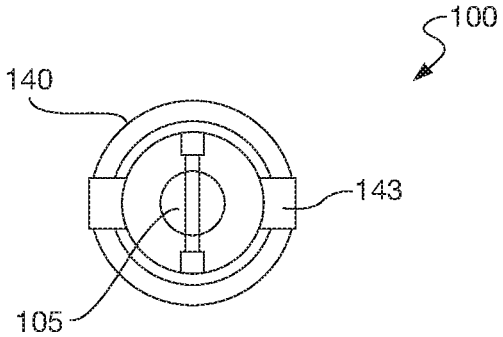
FIG. 5B is a top view of the standing valve puller of FIG. 5A.

FIG. 5B is a top view of the standing valve puller 100 of FIG. 5A. A through-opening 105 is seen in the top housing 140. The through-opening 105 resides between the flanges 122 of the arms 125, and is dimensioned to slidingly receive the stem 116 when the standing valve puller 100 is in its latched position. In one embodiment, only a very small through-opening 105 is preserved—large enough to encompass the stem 116. Of course, when the flanges are opened, the shoulder 114 is able to pass through the arms 125 to engage the sliding component 130.

Figure 5C:
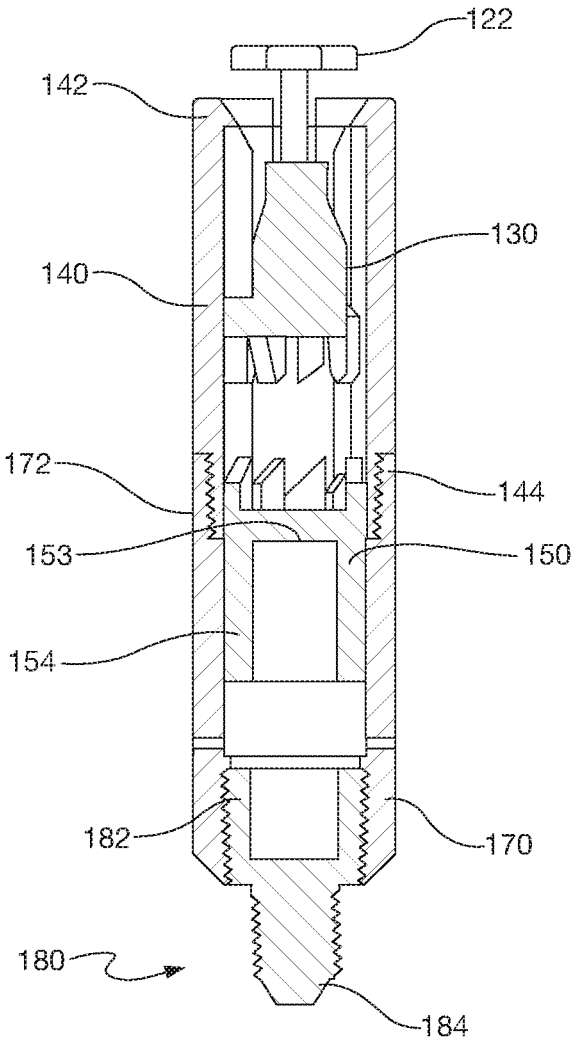
FIG. 5C is another cross-sectional view of the standing valve puller of FIG. 1, but rotated 90-degrees relative to FIG. 5A. The view is taken across Line C-C of FIG. 5A. Here, the standing valve puller is in its latched position.

FIG. 5C is a cross-sectional view of the standing valve puller 100 of FIG. 5A. The view is rotated 90-degrees relative to FIG. 5A, and is taken across Line C-C of FIG. 5A. The engagement pin 110 again is not shown. One of the arms 125 is visible extending up from the top 142 of the top housing 140.

It is observed that in FIG. 5C, the spring 160 has been removed. The twisting component 150 is, for illustrative purposes, not being urged upwardly against the sliding component 130.

Figure 6A:
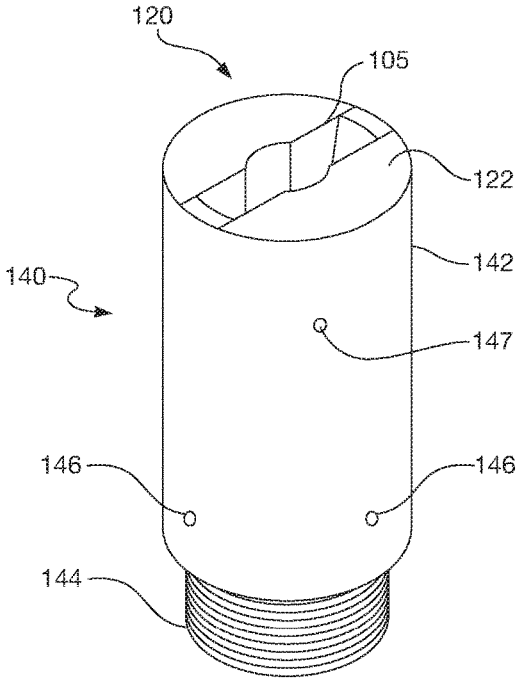
FIG. 6A is a perspective view of a top housing component of the standing valve puller of FIG. 2, in one embodiment. Two arms are shown nested at the upper end of the top housing component.
Figure 6B:
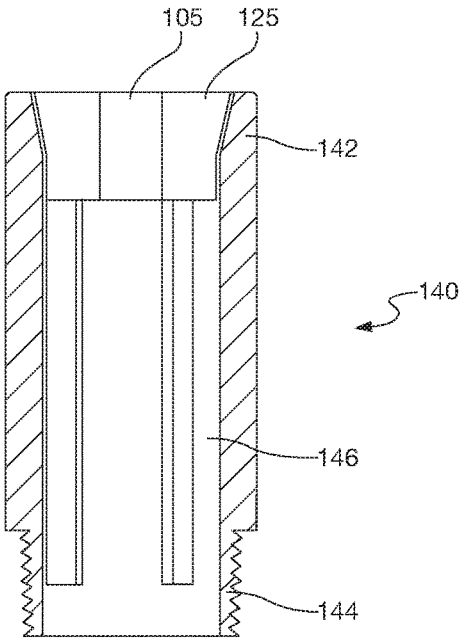
FIG. 6B is a cross-sectional view of the top housing component of FIG. 6A. Here, the arms have been removed.

FIG. 6A is a perspective view of the top housing component 140, in one embodiment. The arms 125 are shown in their latched position at the upper end 142 of the top housing component 140. The arms are designed to pivot outwardly onto respective slanted surfaces, shown at 142 in FIG. 6B. An optional angled flat surface is provided at the back of each arm 125 for landing on a respective slanted surface 142.

FIG. 6B is a cross-sectional view of the top housing component 140 of FIG. 6A. Of interest, channels 146 are shown residing along an inner diameter of the top housing component 140. The channels 146 are configured to receive the splines 135 of the sliding component 130 during its travel up and down the top housing 140. The channels 146 also rotationally fix the sliding component 130 within the upper housing 140, as noted above.

Figure 7A:
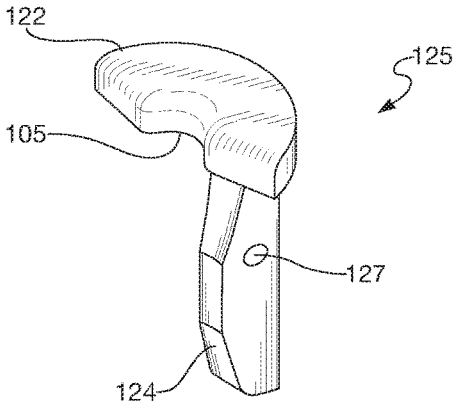
FIG. 7A is a perspective view of one of the arms of the holding arm component of FIG. 6A.
Figure 7B:
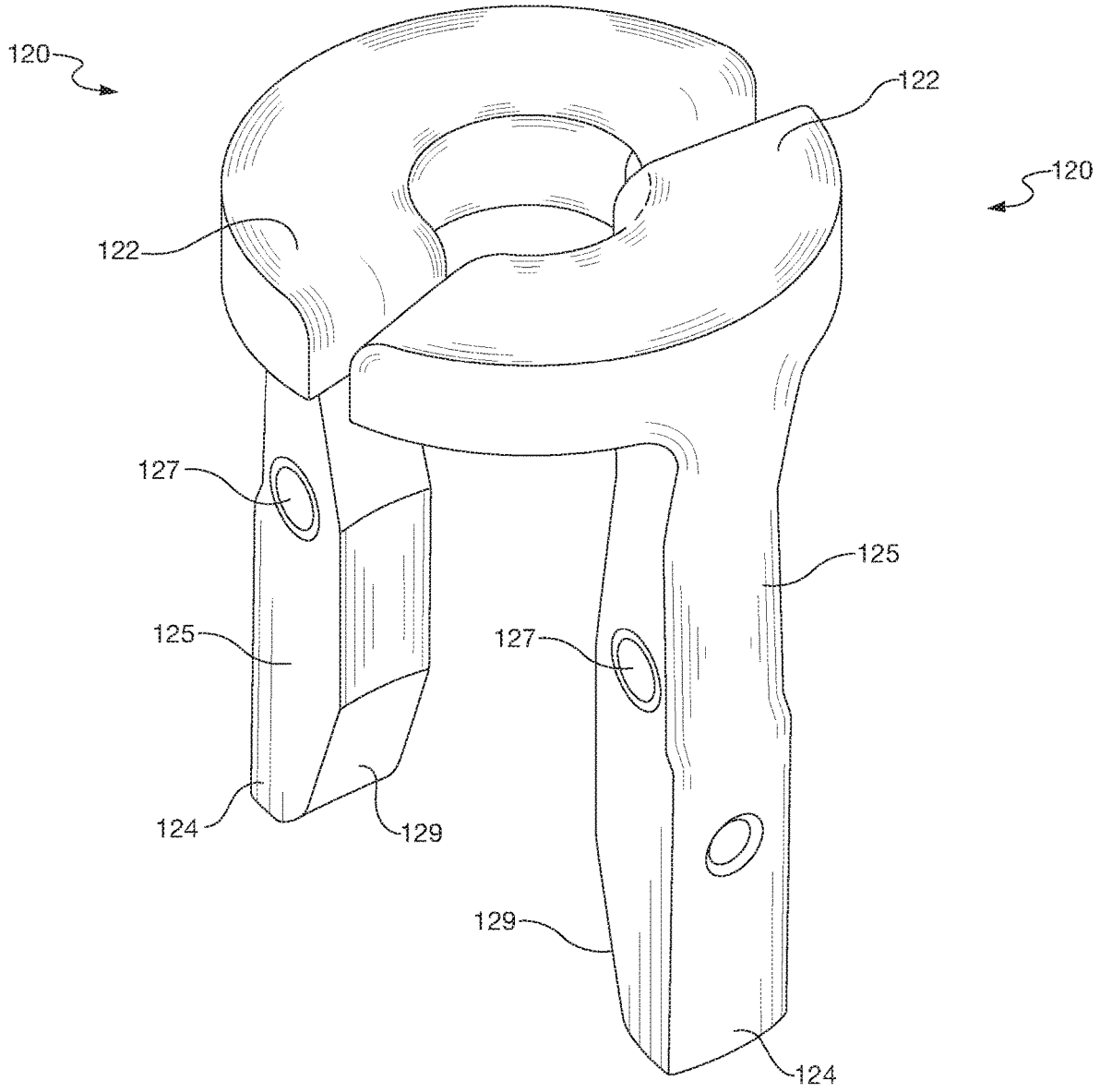
FIG. 7B is a perspective view of the holding arm component. Here, both arms of the holding arm component are shown, in side-by-side arrangement. The holding arm component is in the latched position.

FIG. 7A is a perspective view of one of the arms 125 of the holding arm component 120 of FIGS. 1, 4A and 4B. FIG. 7A shows a flange 122 serving as the upper end of the arm 125. The central bore 105 is indicated as a concave, semi-circular area. It is noted that the inventions herein are not limited to any particular embodiment of an arm 125 so long as the valve puller 100 is able to pivot into and away from the stem 116 in response to depression of the engagement pin 110 against the sliding component 130.

FIG. 7B is perspective view of the holding arm component 120. In this view, both arms 125 of the component 120 are presented. The arms 125 are pivoted inwardly for illustrative purposes. Of interest, through-openings 127 are shown through each of the legs 125 for receiving a pivot pin (not shown).

It is noted that the lower end 124 of each arm includes a beveled inward surface 129. The beveled inward surface 129 of each of the legs 125 accommodates the pivoting action of the legs 125, permitting the legs 125 to more fully pivot outwardly into the beveled upper surface 142. At the same time, the beveled surfaces 129 receive the shoulder 114 when the engagement pin 110 is moved downwardly into the standing valve puller 100.

An upper rear surface 121 of each arm 125 offers a curvilinear profile. This profile is intended to match the slope of the slanted surface 142, allowing the arms 125 to rest against the slanted surface 142 when the arms 125 pivot outwardly.

Figure 7C:
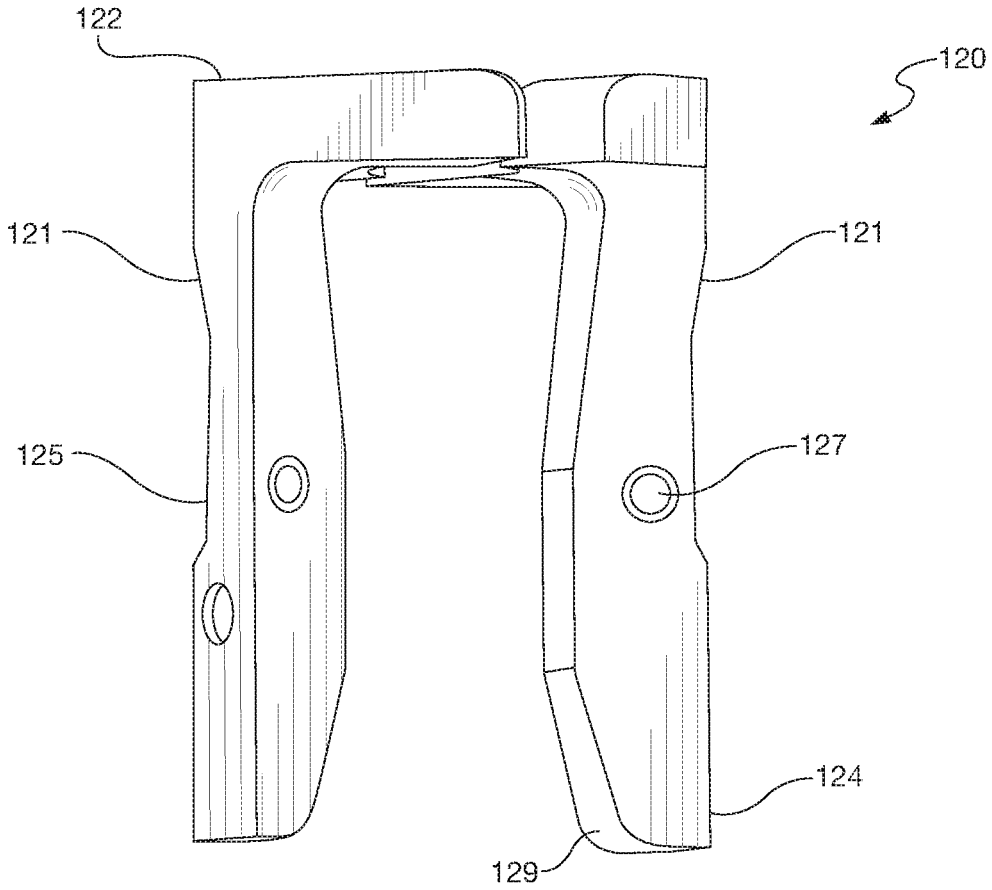
FIG. 7C is another perspective view of the holding arm component. Here, the arms of the holding arm component are again in their latched position.

FIG. 7C is another perspective view of the holding arm component 120. Here, the holding arm component 120 is again in its latched position.

Figure 8:
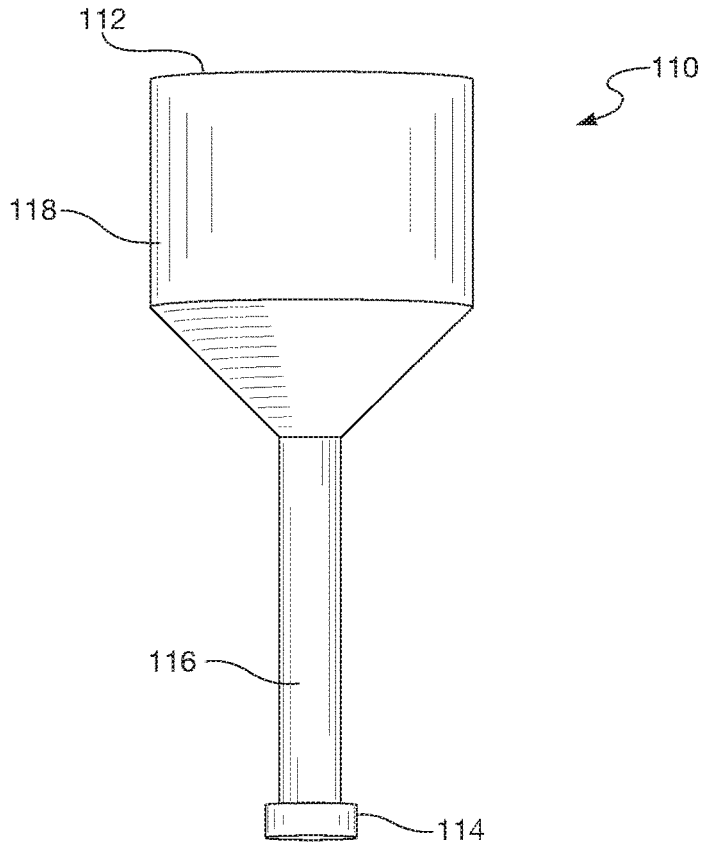
FIG. 8 is a side view of the holding arm component of FIG. 7B. Here, the arms of the holding arm component have been pivoted into their open position, ready to receive an engagement pin. An engagement pin is shown above the holding arm component.
Figure 8:
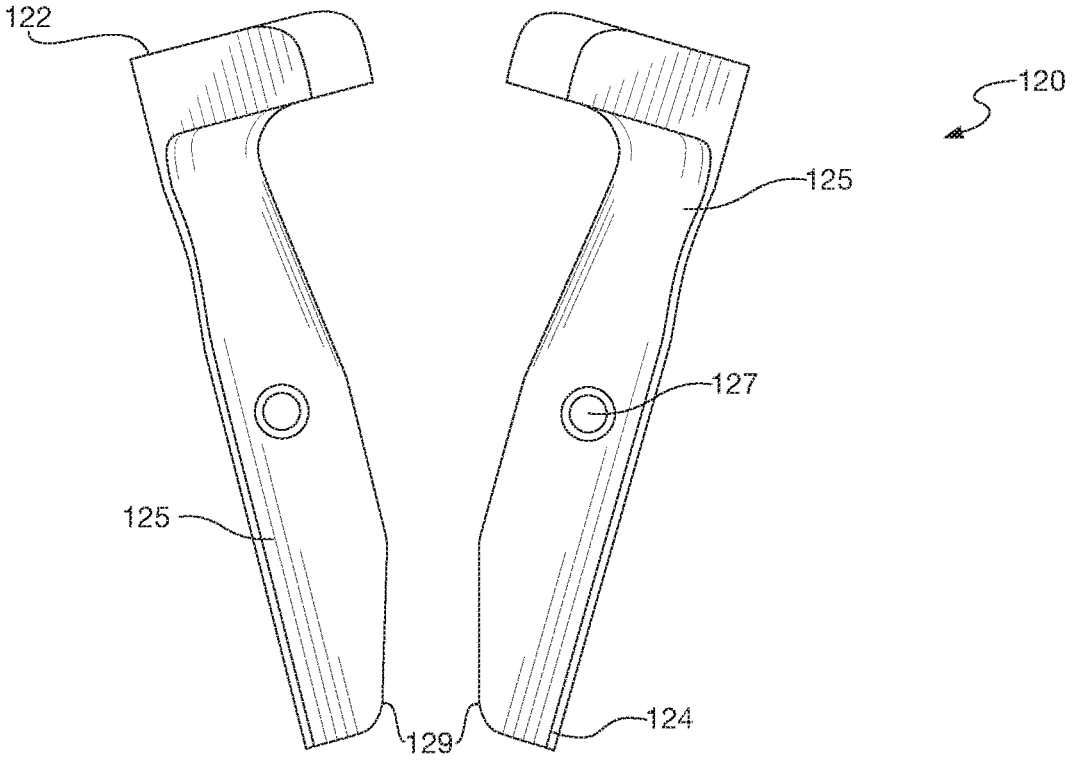

FIG. 8 is still another perspective view of the holding arm component 120. In this view, the individual arms 125 have been pivoted outward into their "released" position. An engagement pin 110 is positioned above the holding arm component 120, ready to move down through the central bore 105 and to depress the sliding component 130.

It is again understood that springs (not shown) may be placed behind the individual arms 125 in order to bias the arms 125 away from each other. This accommodates lowering of the engagement pin 110 through the central bore 105 and into the upper housing 130.

As can be seen, an improved standing valve puller 100 is offered. The standing valve puller 100 operates with an engagement pin 110 to provide a "latch and release" arrangement. In addition, a novel method of unseating a standing valve 960 from a seating nipple 918 within a wellbore 900 is offered herein.

Figures 9A, 9B, 9C:
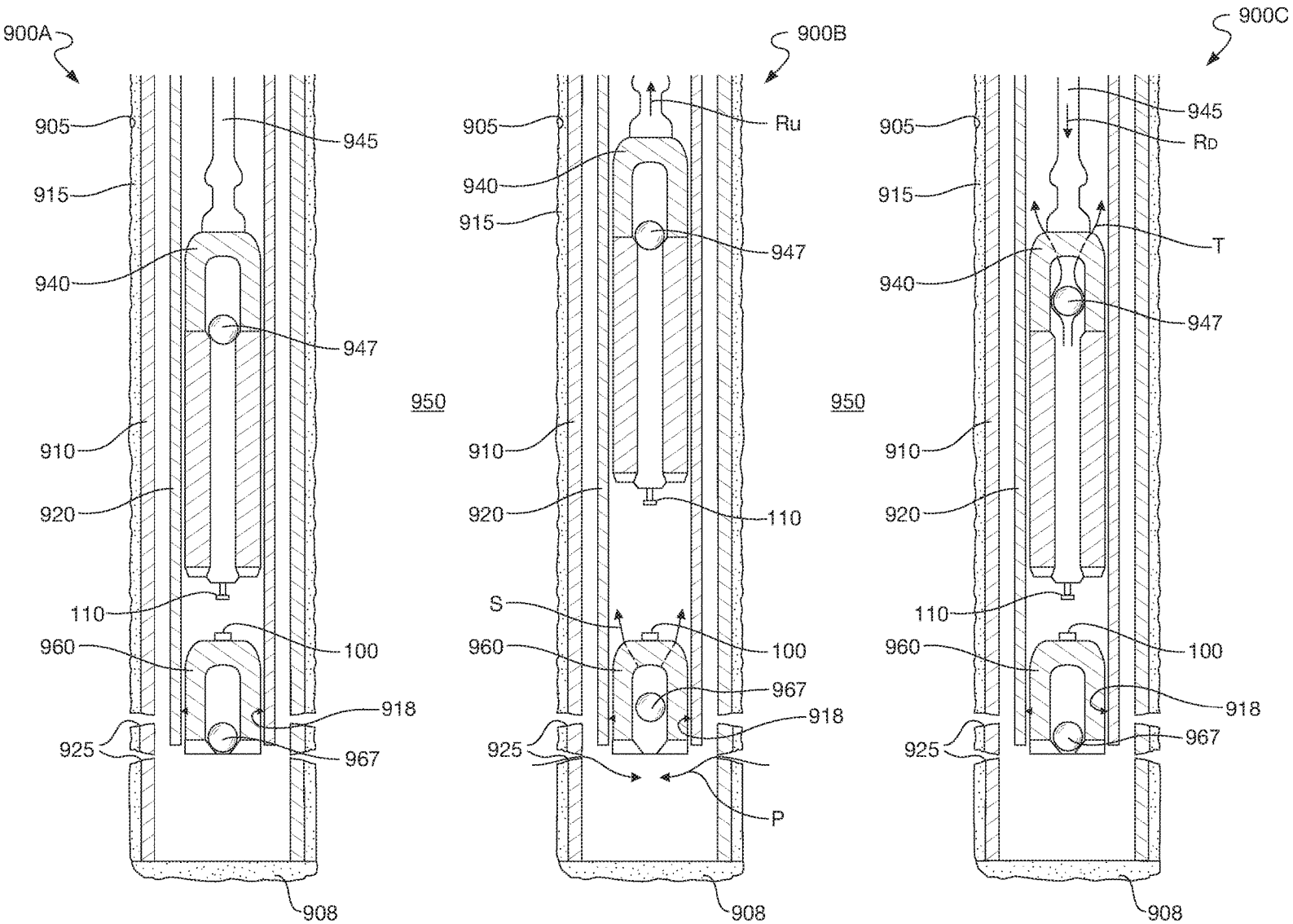
FIG. 9A is a cross-sectional view of a wellbore housing a positive displacement pump. A standing valve puller has been placed at an upper end of the standing valve, while an engagement pin is placed at a lower end of the traveling valve.
FIG. 9B shows the traveling valve being lifted within the wellbore by a sucker rod string.
FIG. 9C shows the traveling valve being lowered within the wellbore by the sucker rod string.

FIG. 9A provides a cross-sectional view of a wellbore 900A that has been completed in a vertical orientation. Only a lower portion of the wellbore 900A is shown.

The wellbore 900A defines a cylindrical bore 905 that has been drilled into an earth subsurface 950. The cylindrical bore 905 is lined with a series of steel casings, with each string of casing having a progressively smaller outer diameter. In FIG. 9A, only the lowermost string of casing is shown. This is referred to as a production casing 910.

The production casing 910 has been cemented into place. A column of cement 915 is shown having been squeezed into an annular area formed between the production casing 910 and the surrounding earth formation 950. In addition, the casing 910 and cement column 915 have been perforated. Illustrative perforations are shown at 925. The perforations 925 allow reservoir fluids to flow into the wellbore 900A.

After perforating, the formation 950 is typically acidized and/or fractured through the perforations 925. Hydraulic fracturing consists of injecting water with friction reducers or viscous fluids (usually shear thinning, non-Newtonian gels or emulsions) into a formation at such high pressures and rates that the reservoir rock parts and forms a network of fractures. The fracturing fluid is typically mixed with a proppant material such as sand, ceramic beads or other granular materials. The proppant serves to hold the fractures open after the hydraulic pressures are released. In the case of so-called "tight" or unconventional formations, the combination of fractures and injected proppant substantially increases the flow capacity, or permeability, of the treated reservoir.

In FIG. 9A, the production casing 910 has received a positive displacement pump. The pump represents a traveling valve 940 and a standing valve 960. The traveling valve 940 is disposed at the lower end of a sucker rod string 945. Those of ordinary skill in the art will understand that the traveling valve 940 is reciprocated up and down within the wellbore 900 in response to movement of a prime mover at the surface. Such a prime mover may be, for example, a hydraulic pumping unit, and pneumatic pumping unit or a mechanical pumping unit. The present inventions are not limited by the manner in which the traveling valve 940 is reciprocated.

At the bottom of the production tubing 920 is the standing valve 960. The standing valve 960 is held in place within the production tubing 920 by means of an internal constriction, or "seating nipple," (shown in FIGS. 9E and 9F) formed internally of the tubing string 920. A metallic enlargement on the external body of the standing valve 960 (referred to as a "pump barrel") prevents the standing valve 960 from moving below the seating nipple. Elastomeric seal rings on the outer body of the pump barrel form a leak proof seal between the standing valve 960 and the seating nipple 918.

The standing valve 960 is usually installed after the production string 920 is in place within the wellbore 900. More specifically, the standing valve 960 is typically installed by running the standing valve 960 into the production tubing 920 at the lower end of the sucker rod string 945. In practice, the traveling valve 940 is threadedly connected to a lowest joint of the rod string 945. The standing valve 960, in turn, is threadedly connected to the standing valve 960 so that the rod string 945, the traveling valve 940 and the standing valve 960 are all run into the wellbore 900 together. However, one object of the present inventions is to eliminate the threaded connection between the traveling valve 940 and the standing valve 960, and use the standing valve puller 100 in its place.

In FIG. 9A, a standing valve puller 100 is shown schematically, connected to the standing valve 960. The standing valve puller 100 is secured by means of a threaded connection through the threaded end 184 of the threaded connector 180. Of interest, the standing valve puller 100 will remain connected to the standing valve 960 while the standing valve 960 is fixed downhole on the seating nipple 918.

Also seen in FIG. 9A is an engagement pin 110. The engagement pin 110 is secured to a lower end of the traveling valve 940 by means of the threads within the box connector 118. As with the standing valve puller 100, the engagement pin 110 will remain in the wellbore 900 during production operations.

FIG. 9B shows the traveling valve 940 being lifted within the production tubing 920 by the sucker rod string 945. This is indicated at wellbore designation 900B. The upward action of the rod string 945 causes a ball 947 in the traveling valve 940 to seat. This, in turn, allows the traveling valve 940 to raise production fluids up the production tubing 920 and to a well head and fluid separation equipment (not shown) at the surface. Arrow $R_U$ indicates upward movement of the rod string 945 and connected traveling valve 940. Arrow P indicates an in-flow of production fluids into the wellbore 900B.

FIG. 9B also shows that the standing valve 960 remains affixed to the bottom of the production tubing 920. As the traveling valve 940 pushes production fluids up the production tubing 920, negative pressure is created below the traveling valve 940. This causes a ball 967 associated with the standing valve 960 to become unseated, which in turn pulls production fluids entering the wellbore 900 into the standing valve 960. The production fluids travel through ports in the standing valve 960 and into the production tubing 920 as shown by Arrow S.

FIG. 9C shows the traveling valve 940 being lowered back down the production tubing 920 by the sucker rod string 945. This is indicated at wellbore designation 900C. Arrow RD demonstrates the downward movement of the sucker rod string 945. Downward movement of the connected traveling valve 940 increases fluid pressure above the standing valve 960, which causes the ball 967 in the standing valve 960 to seat.

FIG. 9C also shows that the ball 947 in the traveling valve 940 has unseated. This allows production fluids to pass through the traveling valve 940, and to flow through ports and up the production tubing 920. Arrow T indicates upward fluid movement through the traveling valve 940.

Figure 9F:
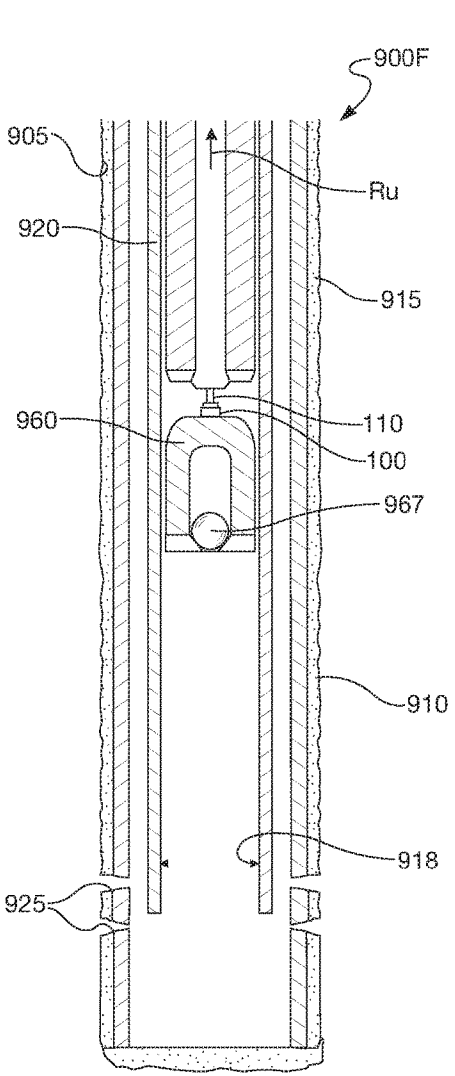
FIG. 9F shows the standing valve being raised further up the wellbore, connected to the traveling valve.
Figure 9E:
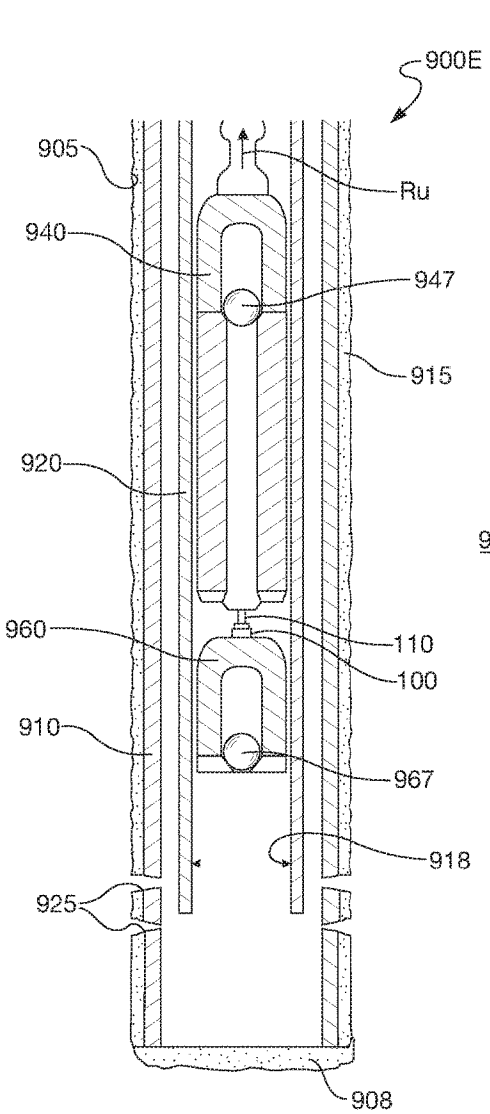
FIG. 9E shows the standing valve being raised up the wellbore, connected to the traveling valve.
Figure 9D:
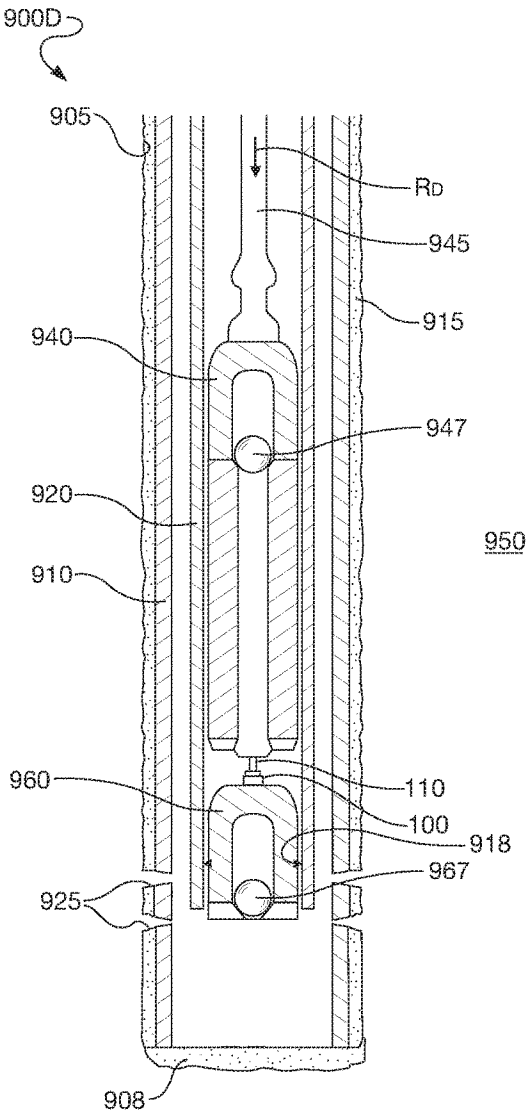
FIG. 9D shows the traveling valve being lowered down onto the standing valve. The engagement pin has latched into the standing valve puller.

FIG. 9D is another side view of the wellbore 900. This is indicated at wellbore designation 900D. This view shows the traveling valve 940 being lowered down onto the standing valve 960. Here, the engagement pin 110 has latched into the seated standing valve puller 100.

FIG. 9E is a next side view of the wellbore 900. This is indicated at wellbore designation 900E. In this view, the traveling valve 940 is being raised up the production tubing 920. Because the engagement pin 110 has latched onto the standing valve puller 100, the traveling valve 940 is able to quickly unseat the standing valve 960 from the seating nipple 918 and raise the standing valve up the wellbore 900.

FIG. 9F is a final side view of the wellbore 900. This is indicated at wellbore designation 900F. In this view, the standing valve 960 is being raised further up the wellbore 900, connected to the traveling valve 940, and en route to the surface.

Based on FIGS. 9A through 9F, a method of unseating a standing valve 960 may be seen. The method first includes lowering the sucker rod string 945 and connected traveling valve 940 and engagement pin 110 within the wellbore 900. This may be done by removing the top clamps on the pumping unit at the surface, providing for a longer stroke. The method then includes further lowering the rod string 945 and connected traveling valve 940 and engagement pin 110 within the wellbore 900 in order to apply a downward force to a sliding component 130 within the standing valve puller 100. This is per the view of FIG. 9D. This causes arms 125 of a holding arm component 120 to pivot inward, and to engage (or latch onto) the engagement pin 110.

When engaged, the arms 125 of the holding arm component 120 will be forced to hold the stem 116 of the engagement pin 110. From there, the entire standing valve puller 100 and threadedly connected standing valve 960 can be lifted to the surface per FIG. 9F. Alternatively, the unseated standing valve 960 can be simply raised by the operator at the surface by moving the pumping unit to its upstroke. This is per the view of FIG. 9E. In this instance, the operator can inject or circulate a hot oil treatment or a chemical treatment into the tubing string 920, all without pulling the rod string 945 out of the hole 905.

Interestingly, present methods of cleaning out a standing valve 960 downhole require pumping down the back side of the production tubing 920. With the current method, treatment fluids directly treat the production tubing 920, rod string 945 and pump 940/960.

The method also includes:

- applying an upward tensile force to the rod string 945 and connected traveling valve 940 and engagement pin 110;
- removing the sucker rod string 945 from the wellbore 900, joint-by-joint, up to a surface; and
- removing the standing valve 960 from the engagement pin 110 at the surface.

Preferably, the wellbore 900 is completed in a substantially vertical orientation.

A fluid pumping system for producing hydrocarbon fluids from a wellbore 900 is also provided herein. Once again, the wellbore has a string of production tubing 920 placed therein.

The fluid pumping system first includes a traveling valve. The traveling valve resides at a lower end of a rod string within the string of production tubing. The fluid pumping system also includes an engagement pin. The engagement pin is connected to the lower end of the traveling valve. Thus, the traveling valve and connected engagement pin move up and down within the production tubing together in response to reciprocal pumping motion of the rod string.

The fluid pumping system next includes a standing valve. The standing valve is landed on a seating nipple or similar restriction within the production tubing.

Additionally, the fluid pumping system comprises a standing valve puller. The standing valve puller is threadedly connected to the standing valve at a top end. The standing valve puller is designed in accordance with the standing valve puller 100 described above, in its various embodiments.

Using the fluid pumping system, a method of unseating a wellbore tool may also be provided. Generally, the method includes:

running an engagement pin into the wellbore, wherein a lower end of the engagement pin comprises a shoulder;

lowering the engagement pin through a through-opening in a downhole tool puller, thereby causing arms at a top end of the tool puller to pivot onto the engagement pin above the shoulder;

raising the engagement pin in order to engage the shoulder with the arms; and applying an upward force on the engagement pin, thereby unseating a wellbore tool connected to the downhole tool puller.

In a preferred embodiment, the engagement pin resides at a lower end of a traveling valve within a wellbore. The traveling valve, in turn, is connected to a lower end of a sucker rod string. The sucker rod string, in turn, is operatively connected proximate a surface to a polished rod. Those of ordinary skill in the art of upstream artificial lift will understand that the polished rod reciprocates up and down over the wellbore, through rod packing, in order to reciprocate the sucker rod string.

In this preferred embodiment, the wellbore tool is a standing valve seated along a string of production tubing within the wellbore. In this case, lowering the engagement pin may comprise raising clamps along the polished rod, and then causing a surface pumping unit to rotate (or "roll over") so as to lower the polished rod and connected rod string within the wellbore. This allows the field supervisor or "pumper" to "tag" the well. Tagging the well is typically used to break up a gas lock. In the present method, tagging may also be used to tag the engagement pin to the downhole tool puller. The upward force can then be applied in order to unseat the standing valve.

In one embodiment, once the standing valve is unseated, a chemical treatment may be applied downhole. Such a chemical treatment may be, for example, a hot oil treatment. Beneficially, this may be done without pulling the traveling valve out of the hole or even removing any joints of the sucker rod string.

Further, variations of the fluid pumping system and of the method for unseating a standing valve may fall within the spirit of the claims, below. For example, the standing valve puller may be used as a generic running tool for seating and unseating other tubular devices within a wellbore. It will be appreciated that the inventions are susceptible to modification, variation and change without departing from the spirit thereof.

What is claimed is:

1. A standing valve puller configured to retrieve a standing valve from a wellbore, wherein the wellbore comprises a string of production tubing, and the standing valve puller comprises:

a tubular housing comprising a proximal end and a distal end, and a bore there along;

a connector at the distal end of the tubular housing for connecting the tubular housing to a standing valve;

a spring residing within the bore of the tubular housing and abutting the connector;

a sliding component configured to move along the bore of the tubular housing in response to a longitudinal force applied by an engagement pin, wherein the sliding component includes a series of splines residing radially around an outer diameter of the sliding component; and a holding arm component comprising at least two arms, wherein each of the at least two arms is configured to pivot at the proximal end of the tubular housing such that when the engagement pin moves into the bore a first time, the arms pivot inwardly into a latched position and latch onto a stem of the engagement pin, but when the engagement pin moves into the bore a second time, the arms pivot outwardly to a released position and release the engagement pin.

2. The standing valve puller of claim 1, wherein a longitudinal movement of the engagement pin urges the sliding component to move within and towards the distal end of the tubular housing.

3. The standing valve puller of claim 2, further comprising:

a twisting component residing within the bore of the tubular housing and forming a generally tubular body, wherein the twisting component comprises (i) a shoulder configured to land on the spring, thereby enabling the spring to apply a biasing force to the twisting component towards the proximal end of the tubular housing, and (ii) a series of slots residing radially about the tubular body, wherein the slots alternate between short slots and long slots, such that sequential force actions by the sliding component on the twisting component causes the splines to move towards the proximal end of the tubular housing along the slots and to radially advance the splines from long slots to short slots and again to long slots;

wherein when the splines move into the long slots, the arms of the holding arm component pivot inwardly to the latched position while preserving a through-opening therein, but when the splines move into the short slots, the arms of the holding arm component pivot outwardly to the released position.

4. The standing valve puller of claim 3, wherein:

the connector is a threaded connector having a proximal end and a distal end, wherein the proximal end is connected to the distal end of the tubular housing, and the distal end comprises male threads configured to threadedly connect to a threaded opening at a proximal end of the standing valve; and the shoulder of the twisting component resides along an inner diameter of the tubular body forming the twisting component.

5. The standing valve puller of claim 4, wherein the tubular housing further comprises:

a top housing component having a proximal end and a distal end, with the proximal end having a pair of opposing slanted surfaces configured to pivotally receive the opposing arms of the holding arm component, and the distal end forms a threaded male coupling; and a bottom housing component also having a proximal end and a distal end, wherein the proximal end forms a threaded female coupling configured to connect to the threaded male coupling of the top housing component, and the distal end also forms a threaded female coupling that connects to the threaded connector.

6. The standing valve puller of claim 4, wherein:

the inner bore comprises an inner diameter of the top housing and the bottom housing together;

the inner bore comprises a plurality of channels along the top housing; and the channels are configured to receive the slots of the sliding component to radially fix the sliding component within the bore.

7. The standing valve of claim 4, wherein:

the through-opening of the holding arm component is configured to slidingly receive the stem of the engagement pin; and the proximal end of the sliding component is configured to receive the longitudinal force of the engagement pin when the engagement pin moves through a through-opening of the sliding component and into the tubular housing.

8. The standing valve of claim 4, wherein the threaded connector is integral to the distal end of the tubular housing.

9. The standing valve puller of claim 4, wherein the wellbore is completed in a substantially vertical orientation.

10. A fluid pumping system for producing hydrocarbon fluids from a wellbore, comprising:

a traveling valve residing at a lower end of a rod string within a string of production tubing;

an engagement pin residing at a lower end of the traveling valve, the engagement pin defining an elongated stem having a shoulder at a distal end of the stem;

a standing valve landed on a seating nipple within the production tubing; and a standing valve puller threadedly connected to the standing valve, wherein the standing valve puller comprises:

a tubular housing comprising a proximal end and a distal end, and a bore there along;

a connector at the distal end of the tubular housing for connecting the tubular housing to the standing valve;

a spring residing within the bore of the tubular housing and configured to reside at the proximal end of the connector;

a sliding component configured to move along an inner diameter of the tubular housing in response to a longitudinal force applied by the engagement pin, wherein the sliding component includes a series of splines residing radially around an outer diameter of the sliding component; and a holding arm component comprising at least two arms, wherein each of the at least two arms is configured to pivot at the proximal end of the tubular housing such that when the engagement pin moves into the bore a first time, the arms pivot inwardly to a latched position and latch onto the stem of the engagement pin, but when the engagement pin moves into the bore a second time, the arms pivot outwardly to a released position and release the stem of the engagement pin.

11. The fluid pumping system of claim 10, wherein movement of the engagement pin into the bore of the tubular housing urges the sliding component to move within and towards the distal end of the tubular housing.

12. The fluid pumping system of claim 11, further comprising:

a twisting component residing within the bore of the tubular housing and forming a generally tubular body, wherein the twisting component comprises (i) a shoulder configured to land on the spring, thereby enabling the spring to apply a biasing force to the twisting component towards the proximal end of the tubular housing, and (ii) a series of slots residing radially about the tubular body, wherein the slots alternate between short slots and long slots, such that sequential actions by the sliding component on the twisting component causes the splines to move towards the proximal end of the tubular housing along the slots and to radially advance the splines from long slots to short slots and again to long slots;

wherein when the splines move into the long slots, the arms of the holding arm component pivot inwardly to the latched position while preserving a through-opening therein, but when the splines move into the short slots, the arms of the holding arm component pivot outwardly to the released position.

13. The fluid pumping system of claim 12, wherein:

the shoulder of the twisting component resides along an inner diameter of the tubular body forming the twisting component; and the tubular housing comprises:

a top housing component having a proximal end and a distal end, with the proximal end having a pair of opposing slanted surfaces configured to pivotally receive the opposing arms of the holding arm component, and the distal end forms a threaded male coupling; and a bottom housing component also having a proximal end and a distal end, wherein the proximal end forms a threaded female coupling configured to connect to the threaded male coupling of the top housing component, and the distal end also forms a threaded female coupling that connects to the threaded connector.

14. The fluid pumping system of claim 13, wherein:

the connector is a threaded connector having a proximal end and a distal end, wherein the proximal end is configured to threadedly connect to the distal end of the tubular housing, and the distal end comprises male threads configured to threadedly connect to a threaded opening at a proximal end of the standing valve; and the proximal end of the sliding component is configured to receive the longitudinal force of from the shoulder of the engagement pin when the engagement pin moves through the through-opening of a sliding component and into the tubular housing.

15. The fluid pumping system of claim 14, wherein:

the inner bore comprises an inner diameter of the top housing and the bottom housing together;

the inner bore comprises a plurality of channels along the top housing; and the channels are configured to receive the slots of the sliding component to radially fix the sliding component within the bore.

16. The fluid pumping system of claim 13, wherein the threaded connector is integral to the distal end of the tubular housing.

17. A method of unseating a standing valve from a seating nipple within a wellbore, wherein:

the wellbore has:

an elongated string of production tubing therein, and a standing valve secured onto a seating nipple proximate a lower end of the production tubing;

a standing valve puller threadedly connected onto an upper end of the standing valve, the standing valve puller comprising:

a tubular housing comprising a proximal end and a distal end, and a bore there through;

a spring residing within the bore of the tubular housing and abutting the threaded connector; and a sliding component configured to move along the bore of the tubular housing in response to the downhole force applied by the engagement pin, wherein the sliding component includes a series of splines residing radially around an outer diameter of the sliding component;

a traveling valve secured to a lowermost joint of a sucker rod string; and an engagement pin secured to a lower end of the traveling valve;

and the method comprises:

lowering the rod string and connected traveling valve and engagement pin within the wellbore;

further lowering the rod string and connected traveling valve and engagement pin within the wellbore in order to apply a downhole force to a sliding component within the standing valve puller, thereby causing arms of a holding arm component to pivot inward and to latch onto the engagement pin;

applying an upward tensile force to the rod string and connected traveling valve and engagement pin;

removing the sucker rod string from the wellbore, joint-by-joint, up to a surface, with the traveling valve, engagement pin, standing valve puller and standing valve all connected in series.

18. The method of claim 17, wherein the standing valve puller further comprises:

a threaded connector at the distal end of the tubular housing;

a holding arm component comprising at least two arms, wherein each of the at least two arms is configured to pivot at the proximal end of the tubular housing such that when the engagement pin moves the sliding component into the bore a first time, the arms pivot inwardly and latch onto a stem of the engagement pin, but when the engagement pin moves the sliding component downward into the bore a second time, the arms pivot outwardly and release the shoulder of the engagement pin; and wherein downhole movement of the engagement pin urges the sliding component to move towards the distal end of the tubular housing.

19. The method of claim 18, wherein the standing valve puller further comprises:

a twisting component residing within the bore of the tubular housing and forming a generally tubular body, wherein the twisting component comprises (i) a shoulder configured to land on the spring, thereby enabling the spring to apply a biasing force to the twisting component towards the proximal end of the tubular housing, and (ii) a series of slots residing radially about the tubular body, wherein the slots alternate between short slots and long slots, such that sequential downhole actions by the sliding component on the twisting component causes the splines to move towards the proximal end of the tubular housing along the slots and to radially advance the splines from long slots to short slots and again to long slots;

wherein when the splines move into the long slots, the arms of the holding arm component pivot inwardly to a latched position while preserving a through-opening therein, but when the splines move into the short slots, the arms of the holding arm component pivot outwardly to a released position.

20. The method of claim 19, wherein:

the shoulder of the twisting component resides along an inner diameter of tubular body forming the twisting component; and the tubular housing comprises:

a top housing component having a proximal end and a distal end, with the proximal end having a pair of opposing slanted surfaces configured to pivotally receive the opposing arms of the holding arm component, and the distal end forms a threaded male coupling; and a bottom housing component also having a proximal end and a distal end, wherein the proximal end forms a threaded female coupling configured to connect to the threaded male coupling of the top housing component, and the distal end also forms a threaded female coupling that connects to the threaded connector.

21. The method of claim 20, wherein:

the through-opening of the holding arm component is configured to slidingly receive the stem of the engagement pin; and the proximal end of the sliding component is configured to receive a downhole force of a shoulder of the engagement pin when the engagement pin moves through a through-opening of the sliding component and into the tubular housing.

22. The method of claim 21, wherein:

the inner bore comprises an inner diameter of the top housing and the bottom housing together;

the inner bore comprises a plurality of channels along the top housing;

the channels are configured to receive the slots of the sliding component to radially fix the sliding component within the bore; and the wellbore is completed in a substantially vertical orientation.

23. A method of unseating a standing valve, comprising:

running an engagement pin into the wellbore, the engagement pin defining a stem having a shoulder at a distal end of the stem;

lowering the engagement pin through a through-opening in a standing valve puller, thereby causing arms at a proximal end of the standing valve puller to pivot onto the stem above the shoulder;

raising the engagement pin in order to engage the shoulder with the arms; and applying an upward force on the engagement pin, thereby unseating a standing valve threadedly connected to the standing valve puller, and wherein standing valve puller comprises:

a tubular housing comprising a proximal end and a distal end, and a bore there through;

a spring residing within the bore of the tubular housing and abutting the threaded connector; and a sliding component configured to move along the bore of the tubular housing in response to the downhole force applied by the engagement pin, wherein the sliding component includes a series of splines residing radially around an outer diameter of the sliding component.

24. The method of claim 23, wherein:

the standing valve is seated along a string of production tubing within a wellbore;

the engagement pin resides at a downhole end of a traveling valve within the wellbore;

the traveling valve is connected to a downhole end of a sucker rod string;

the sucker rod string is operatively connected proximate a surface to a polished rod;

lowering the engagement pin comprises raising clamps along the polished rod and causing a surface pumping unit to rotate so as to lower the polished rod and connected rod string, and thereby tagging the engagement pin to the standing valve puller.

25. The method of claim 24, further comprising:

raising the sucker rod string and the connected traveling valve, engagement pin, standing valve puller and standing valve together at least partially up the wellbore.

26. The method of claim 25, further comprising:

injecting a chemical treatment into the wellbore without pulling the traveling valve out of the wellbore.

* * * * *